US007910279B2

(12) United States Patent
Maezawa et al.

(10) Patent No.: US 7,910,279 B2
(45) Date of Patent: Mar. 22, 2011

(54) METHOD OF MANUFACTURING AGGREGATE PARTICLES AND TONER

(75) Inventors: Nobuhiro Maezawa, Yamatokoriyama (JP); Katsuru Matsumoto, Nara (JP); Keiichi Kikawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 749 days.

(21) Appl. No.: 11/937,201

(22) Filed: Nov. 8, 2007

(65) Prior Publication Data

US 2008/0248415 A1 Oct. 9, 2008

(30) Foreign Application Priority Data

Nov. 10, 2006 (JP) ..... P2006-306032

(51) Int. Cl.
*G03G 9/08* (2006.01)

(52) U.S. Cl. ..... 430/137.14; 430/137.1

(58) Field of Classification Search ..... 430/137.14, 430/137.1

See application file for complete search history.

(56) References Cited

U.S. PATENT DOCUMENTS

| | | | |
|---|---|---|---|
| 6,500,596 | B2 | 12/2002 | Tanabe et al. |
| 7,284,716 | B2 | 10/2007 | Nakano et al. |
| 2005/0242218 | A1 | 11/2005 | Nakano et al. |
| 2005/0271965 | A1 | 12/2005 | Kamiyoshi et al. |
| 2006/0046178 | A1 | 3/2006 | Akiyama et al. |

FOREIGN PATENT DOCUMENTS

| | | | |
|---|---|---|---|
| CN | 1707365 | A | 12/2005 |
| JP | 2000-275907 | A | 10/2000 |
| JP | 2000-321821 | A | 11/2000 |
| JP | 2001-242663 | | 9/2001 |
| JP | 2001-255697 | | 9/2001 |
| JP | 2004-008898 | | 1/2004 |
| JP | 2004-077693 | | 3/2004 |
| JP | 2004-189765 | A | 7/2004 |
| JP | 2004-204032 | | 7/2004 |
| JP | 2006-65107 | A | 3/2006 |
| WO | 2003/059497 | | 7/2003 |

*Primary Examiner* — Hoa V Le

(74) *Attorney, Agent, or Firm* — Nixon & Vanderhye P.C.

(57) ABSTRACT

A method of manufacturing aggregate particles capable of obtaining aggregate particles having high mechanical strength, small particle size, with narrow particle size distribution width by preventing interfusion of bubbles in the aggregate particles during stirring is provided. Aggregate particles are manufactured by stirring a resin particle slurry including resin particles dispersed in an aqueous medium and contained in a stirring vessel by a stirring section having a impeller and two or more screen members disposed so as to surround the impeller in the stirring vessel and each formed with a plurality of slits and aggregating the resin particles.

10 Claims, 5 Drawing Sheets

METHOD OF MANUFACTURING AGGREGATE PARTICLES AND TONER

CROSS-REFERENCE TO RELATED APPLICATION

This application claims priority to Japanese Patent Application No. 2006-306032, which was filed on Nov. 10, 2006, the contents of which are incorporated herein by reference in its entirety.

BACKGROUND OF THE INVENTION

1. Field of the Invention

The present invention relates to a method of manufacturing aggregate particles and a toner.

2. Description of the Related Art

In an image forming apparatus using an electrophotographic system, toner images are formed by supplying a toner which is in a charged state, to electrostatic latent images formed on the surface of a photoreceptor, and developing the electrostatic latent images and fixing the toner images to a recording medium. In the electrophotographic system, it is demanded for forming images at high image density and excellent in image quality by uniformly depositing the toner to the electrostatic latent images. For forming images of high image density and excellent image quality, it is important that the particle size of the toner is uniform, the width of the particle size distribution is narrow, and the charging performance is uniform. The particle size of the toner gives an effect not only on the charging performance but also on the reproduction of original images at high fineness. A toner having an appropriately small particle size, that is, a toner with a particle size of about 3 to 6 μm is effective for obtaining highly fine images.

Accordingly, various studies have been made so far for making the particle size of the toner uniform and small. For example, as a method of making the toner particle size uniform, a wet method such as an aggregation method or polymerization method has been known. In the method of manufacturing the toner by the aggregation method, aggregate particles as the toner are manufactured, for example, by adding a flocculant such as a bivalent or trivalent metal salt to an aqueous slurry in which fine resin particles, colorant particles, release agent particles, etc. are dispersed thereby aggregating the resin particles, the colorant particles, and the release agent particles. In the polymerization method, a toner is obtained by stirring an aqueous medium containing at least a monomer composition containing a polymerizable monomer and a colorant and a dispersion stabilizer, granulating the monomer composition to an appropriate particle size in the aqueous medium, and polymerizing the polymerizable monomer by a previously added polymerization initiator or a newly added polymerization initiator. In the method of manufacturing the toner using the aggregation method or the polymerization method as described above, since aggregate particles of a uniform particle size can be obtained, it is not necessary to conduct a classification step and the number of manufacturing steps can be decreased compared with the method of manufacturing the toner such as a pulverization method. Further, since the aggregation method and the polymerization method are useful also in view of the cost and decrease of the wastes, further proposals have been made.

In the method of manufacturing the toner using the aggregation method, a technique that defines the stirring conditions for the stirring device in the coagulation step has been proposed (refer, for example, to Japanese Unexamined Patent Publication JP-A 2001-242663). JP-A 2001-242663 discloses a method of manufacturing a toner that defines a preferred liquid surface shape of an aqueous slurry during stirring (referred to as "mixed liquid dispersion" in JP-A 2001242663) and stirs the mixed liquid dispersion such that the liquid surface shape of the mixed liquid dispersion forms a defined liquid surface.

In JP-A 2001-242663, it is defined, as a preferred liquid surface shape of the mixed liquid dispersion during stirring, that the distance Hc between the liquid surface at a central portion of a mixed liquid dispersion and the bottom at the central portion of a reaction vessel during stirring is 0.5 times or less a distance H between the horizontal surface of the mixed liquid dispersion and the bottom at the central portion of the reaction vessel during no stirring, and a distance He between the liquid surface at the end of the mixed liquid dispersion and the bottom at the central portion of the reaction vessel is 1.5 times the distance H during stirring. By stirring the mixed liquid dispersion such that the liquid surface shape of the mixed liquid dispersion forms the suitable liquid surface shape as described above, since mixing of the mixed liquid dispersion during aggregation can be made uniform, and the width of the particle size distribution of the aggregate particles can be made narrow, so that a toner as aggregate particles having a uniform particle size and small particle size can be obtained.

Further, in the method of manufacturing the toner using the polymerization method, a technique of defining the constitution of a stirring device in the granulating step is proposed (refer, for example, to Japanese Unexamined Patent Publication JP-A 2001-255697). JP-A 2001-255697 discloses a method of manufacturing a toner by the polymerization method in a stirring device in which the position for a stirring blade provided to the stirring device and the rotational speed at the top end of the stirring blade is defined. In JP-A 2001-255697, the stirring blade is present at the position with H/D of 0.1 or more where H represents the depth from the water surface to the upper end of the stirring blade and D represents a vessel diameter and the liquid dispersion is stirred under the condition at a velocity at the top end of the stirring blade of 5 m/s or less in the stirring tank having the stirring blade. By improving the stirring condition in the granulating step as described above, a toner comprising aggregate particles of small particle size whose distribution width of particle size is narrow can be obtained.

However, in the method of manufacturing the toner disclosed in JP-A 2001-242663, since the liquid surface shape is concaved into a V-shaped form, this tends to generate macro bubbles when the liquid dispersion continuously involves a gas phase in contact with the liquid dispersion, and bubbles are tended to be included in the aggregate particles. The toner comprising aggregate particles with interfusion of bubbles is poor in mechanical strength and pulverized when stirred in a developing tank to cause a fine powder. In a case where the fine powder is present in the toner, this results in a problem of causing image fogging and blanking of fixed images.

Further, also in the method of manufacturing the toner disclosed in JP-A 2001-255697, it is difficult to prevent the generation of bubbles to result in a problem that the obtained toner comprising the aggregate particles is a toner of low mechanical strength with inclusion of bubbles.

SUMMARY OF THE INVENTION

An object of the invention is to provide a method of manufacturing aggregate particles, in which bubbles are prevented from being interfused into aggregate particles during stirring, and therefore aggregate particles can be obtained that are of high mechanical strength, small in particle size and narrow particle size distribution width, and as well as to provide a toner manufactured by the manufacturing method.

The invention provides a method of manufacturing aggregate particles by aggregating resin particles which are dispersed in a resin particle slurry, the method comprising:

a step of passing a resin particle slurry by rotation of a stirring member, through a plurality of resin particle slurry passing holes which penetrate through two or more screen members in their thickness direction, the two or more screen members being disposed so as to surround the stirring member.

According to the invention, resin particles are aggregated by a granulating apparatus comprising a stirring vessel and a stirring section for stirring a resin particle slurry contained in the stirring vessel. As the stirring section is used a stirring section including a stirring member and two or more screen members. Two or more screen members are disposed so as to surround the stirring member and a plurality of resin particle slurry passing holes are formed in the two or more screen members that penetrate in their thickness direction. When aggregate particles are manufactured by using the stirring section as described above, the resin particle slurry is stirred by the stirring member and the passing state of the resin particle slurry can be controlled when it passes through a plurality of the slurry passing holes formed in two or more screen members to prevent occurrence of vortex flow in the resin particle slurry. This can prevent interfusion of bubbles to the aggregate particles during stirring to improve the mechanical strength of the obtained aggregate particles. Further, since the generation of the vortex flow can be prevented by the provision of two or more screen members, shearing force that can be provided by the stirring member can be increased to obtain aggregate particles further reduced in the diameter irrespective of the narrow particle size distribution width.

Further, in the invention, it is preferable that a volume average particle size of the resin particles is in a range of from 0.3 μm to 2 μm.

According to the invention, a volume average particle size of the resin particles is in a range of from 0.3 μm to 2 μm. A preferred characteristic of the aggregate particles of the invention becomes more remarkable by aggregating such resin particles. The preferred characteristic includes excellent mechanical strength, uniform shape, small particle size, and the narrow particle size distribution width.

Further, in the invention, it is preferable that the resin particles are obtained by finely granulating coarse particles containing the resin by a high pressure homogenizer method.

According to the invention, the resin particles are obtained by finely granulating coarse particles containing the resin by a high pressure homogenizer method. Since the resin particles obtained by finely granulating the coarse particles containing the resin by using the high pressure homogenizer method have a particle size smaller than the particle size of the aggregate particles to be obtained and the variation of the particle size of the resin particles is decreased, variation of the particle size of the aggregate particles obtained by aggregating the resin particles can also be decreased.

Further, in the invention, it is preferable that the resin particle slurry contains an anionic dispersant.

According to the invention, the resin particle slurry contains an anionic dispersant. Since this can control the particle size of the aggregate particles in wide heat temperature region and pressurizing region, and can also prevent excess aggregation, aggregate particles of a narrow particle size distribution width can be manufactured at good yield without conducting precious step control. Further, since the resin particles contain extremely small amount of not aggregated residues, there is scarce material loss.

Further, in the invention, it is preferable that the anionic dispersant is contained in the resin particle slurry at a ratio of 0.1% by weight to 5% by weight based on an entire amount of the resin particle slurry.

According to the invention, since the anionic dispersant is contained in the resin particle slurry at a ratio of 0.1% by weight to 52 by weight based on an entire amount of the resin particle slurry, the addition effect of the anionic dispersant can be obtained most efficiently and deposition of the anionic dispersant to the aggregate particles is suppressed to facilitate the cleaning operation after the formation of the aggregate particles.

Further, in the invention, it is preferable that the anionic dispersant is one or more members selected from sulfonic acid type anionic dispersants, sulfate type anionic dispersants, phosphate type anionic dispersants, and polyacrylate salts.

According to the invention, the anionic dispersant is one or more members selected from sulfonic acid type anionic dispersants, sulfate type anionic dispersants, phosphate type anionic dispersants, and polyacrylate salts. By the use of the anionic dispersant described above, the addition effect of the anionic dispersant can be obtained more remarkably.

Further, in the invention, it is preferable that the resin particle slurry contains a flocculant.

According to the invention, since the resin particle slurry contains a flocculant, the particle size control for the aggregate particles can be facilitated to prevent excess aggregation. Thus, aggregate particles of a narrow particle size distribution width can be manufactured at good yield without conducting precious control. Further, since there is an extremely small amount of not aggregated residues of the resin particles, material loss is scarcely caused.

Further, in the invention, it is preferable that the flocculant is contained in the resin particle slurry at a ratio of 0.1% by weight to 5% by weight based on an entire amount of the resin particle slurry.

According to the invention, since the flocculant is contained in the resin particle slurry at a ratio of 0.1% by weight to 5% by weight based on an entire amount of the resin particle slurry, the addition effect of the flocculant can be obtained most efficiently, and deposition of the flocculant to the aggregate particles is suppressed to facilitate the cleaning operation after formation of the aggregate particles.

Further, in the invention, it is preferable that the flocculant is one or more members selected from monovalent salts, bivalent salts, and trivalent salts.

According to the invention, the flocculant is one or more members selected from monovalent salts, bivalent salts, and trivalent salts. By the use of the flocculant described above, the addition effect of the flocculant can be obtained more remarkably.

Further, in the invention, it is preferable that the resin particle includes a colorant and a release agent together with a synthetic resin.

Further, according to the invention, the resin particles contain a colorant and a release agent in a synthetic resin as a matrix. Further it is preferred that colorant particles and release agent particles having a smaller particle size than that of the resin particles are uniformly dispersed in the synthetic resin as the matrix. The aggregate particles comprising the resin particles described above are pigmented to a desired color and softened at a relatively low temperature of about 100° C. to show an appropriate deforming property. In a case of using such aggregate particles, for example, as a filler for a coating material, adhesion between the coated surface and the coating film, mechanical strength of the coated film, etc. are improved, and a subtle tone is provided to the surface of the coating film. Accordingly, by using the coating material containing such aggregate particles, a coated product exhibiting fine appearance, with less peeling and damages of the coated film, and having a high commercial value can be obtained.

Further, the invention provides a toner manufactured by the method of manufacturing aggregate particles mentioned above.

Further, in the invention, it is preferable that the toner is used as an electrophotographic toner.

According to the invention, since the toner can be manufactured by the method of manufacturing the aggregate particles capable of attaining the effect described above, it is excellent in the mechanical strength, has a smaller particle size and a narrow particle size distribution width. Such a toner is preferably used as an electrophotographic toner, and has a uniform charging performance and can be deposited uniformly to electrostatic latent images to form toner images. Further, since the particle size is decreased appropriately, images reproducing the original images at high fineness can be formed. Further, in a case where the toner comprising the aggregate particles is an aggregated body of resin particles where the colorant particles and the release agent particles are uniformly dispersed in the synthetic resin, the colorant particles and/or release agent particles are scarcely exposed to the surface. Further, the ingredient composition of individual aggregate particles is scarcely changed. Also in view of the above, the aggregate particles of the invention have a uniform charging performance and result in no disadvantage causing image failure such as filming. Accordingly, by using the aggregate particles of the invention, images at high quality having high image density and excellent in the image quality and image reproducibility can be formed stably.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
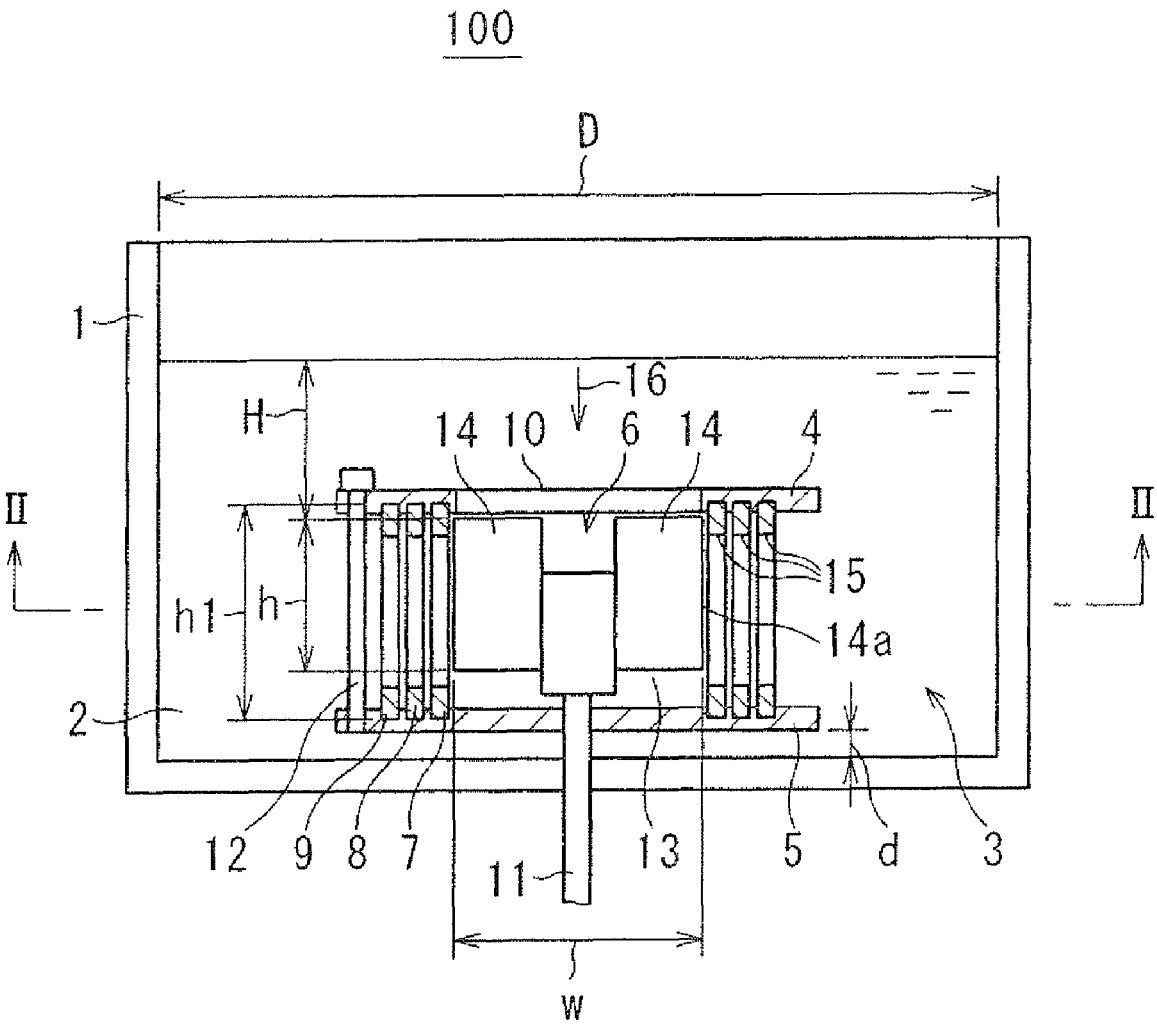
FIG. 1 is a cross sectional view schematically showing a granulating apparatus used in the method of manufacturing aggregate particles of the invention.

Now referring to the drawings, preferred embodiments of the invention are described below.

A method of manufacturing aggregate particles of the invention adopts a granulating apparatus including a stirring vessel for containing a resin particle slurry in which resin particles are dispersed in an aqueous medium, and a stirring section disposed in the stirring vessel for stirring the resin particle slurry contained in the stirring vessel. Further, in the method of manufacturing aggregate particles of the invention, resin particles are aggregated by a granulating apparatus comprising a stirring section including a stirring member for stirring the resin particle slurry contained in the stirring vessel and two or more screen members disposed so as to surround the stirring member and having a plurality of resin particle slurry passing holes formed so as to penetrate in a thickness direction thereof. In other words, a method of manufacturing aggregate particles of the invention aggregates resin particles which are dispersed in a resin particle slurry, and comprises a step of passing a resin particle slurry by rotation of a stirring member, through a plurality of resin particle slurry passing holes which penetrate through two or more screen members in their thickness direction, the two or more screen members being disposed so as to surround the stirring member.

The aggregate particles manufactured by the manufacturing method of the invention are preferably aggregates of resin particles comprising granulation products of the synthetic resins. The aggregate particles manufactured by the manufacturing method of the invention can be used as a toner, for example, in an electrophotographic image forming apparatus such as a copying machine, a laser beam printer, and a facsimile. In addition, they can be used also as a filler for painting materials and coating agents. A granulating apparatus used in the method of manufacturing the aggregate particles of the invention is described below.

Figure 2:
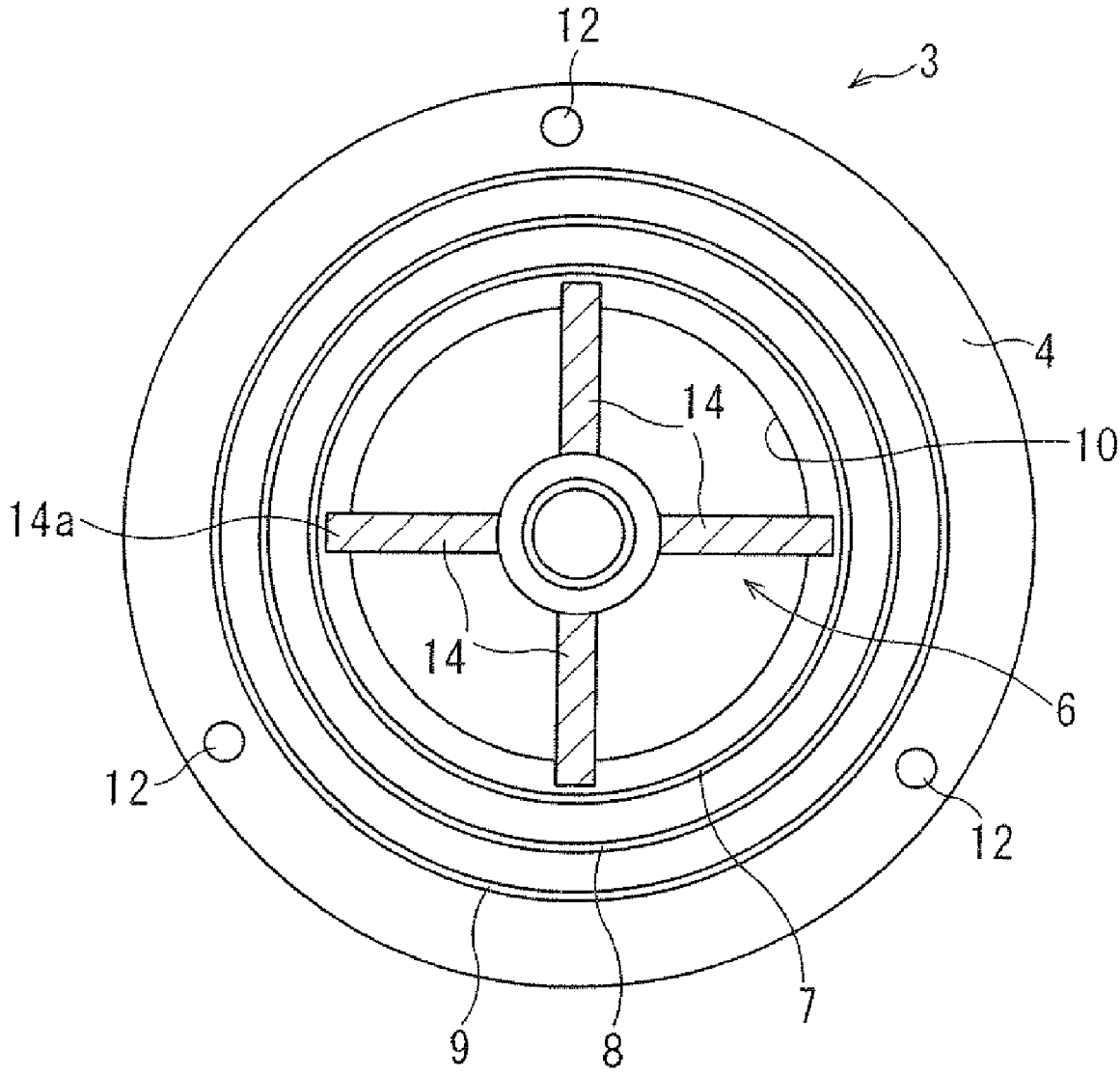
FIG. 2 is a cross sectional view of a stirring section included in the granulating apparatus along a cross sectional line II-II.

FIG. 1 is a cross sectional view schematically showing a granulating apparatus 100 used in the method of manufacturing aggregate particles of the invention. FIG. 2 is a cross sectional view of a stirring section 3 included in the granulating apparatus 100 along a cross sectional line II-II. The granulating apparatus 100 includes, mainly, a stirring vessel 1 and a stirring section 3.

The stirring vessel 1 is a bottomed cylindrical vessel opened upward in a vertical direction and contains a resin particle slurry 2 in which resin particles are dispersed in an aqueous medium. In this embodiment, the stirring vessel 1 is a batchwise vessel open to atmosphere. In this embodiment, the inner diameter D of the stirring vessel 1 is 10.5 cm. While the batchwise vessel open to atmosphere is used as the stirring vessel 1 in this embodiment, this is not restrictive but a closed continuous type (inline type) flowing type vessel may also be used. The stirring vessel 1 is heated by a heating section (not shown), to thereby heat the resin particle slurry 2 to 60° C. to 100° C.

The stirring section 3 is disposed in the stirring vessel 1. The stirring section 3 of this embodiment is intended to make the particle size uniform for the aggregate particles formed by aggregation of the resin particles by high speed rotational stirring of the resin particle slurry 2 contained in the stirring vessel 1 when the resin particles in the resin particle slurry 2 are aggregated.

The stirring section 3 includes a first cover plate 4, a second cover plate 5, an impeller 6 as a stirring member, a first screen member 7, a second screen member 8, and a third screen member 9.

The first cover plate 4 is a disc-shaped member in which a circular slurry inlet hole 10 smaller than the inner diameter of the first screen member 7 to be described later is formed at the center of the disk. Near the periphery of the first cover plate 4, not illustrated three bolt holes are formed in the circumferential direction. Further, three circular recesses are formed on the surface on one side of the first cover plate 4 in the thickness direction so as to be parallel with the circumferential direction of the first cover plate 4. The first, second and third screen members 7, 8, and 9 are supported by the first cover plate 4 by fitting the cylindrical first, second, and third screen members 7, 8, and 9 each at one axial end thereof in the recesses.

The second cover plate 5 is a disk-shaped member having an outer diameter equal with that of the first cover plate 4, in which a not illustrated shaft hole is formed at the center of the disk for inserting and passing the rotational shaft 11 of the impeller 6 therethrough. Near the peripheral of the second cover plate 5, three bolt holes not illustrated in the drawing are formed in the circumferential direction like in the first cover plate 4. Further, three circular recesses are formed at the surface on the other side of the second cover plate 5 in the thickness direction so as to be parallel with the circumferential direction of the second cover plate 5. The first, second, and third screen members 7, 8, and 9 are supported by the second cover plate 5 by fitting in the recesses the first, second, and third screen members 7, 8, and 9 each having a cylindrical shape each at the other axial end thereof.

The first cover plate 4 and the second cover plate 5 are connected at a predetermined distance in the direction of the central axis of the first cover plate 4 and the second cover plate 5 by three bolts 12 fitting or screw coupling with each of the bolt holes. This forms an inter-plate space 13 between the first cover plate 4 and the second cover plate 5.

The impeller 6 is a stirring member for stirring the resin particle slurry 2 in the stirring vessel 1. The impeller 6 in this embodiment is a high speed rotational stirring member having four paddles (stirring blades) 14 fixed to the rotational shaft 11 and the rotational shaft 11 is connected with a not illustrated motor and can be rotated at a desired rotational speed. The impeller C is disposed such that the central axis for the slurry inlet hole 10 is aligned with the axis of the rotational shaft 11. Further, in this embodiment, the stirring section 3 is used in a state where the axis of the rotational shaft 11 is substantially aligned with the vertical direction.

The stirring blade 14 of the impeller 6 is disposed such that the extending direction of the end face 14*a* opposite to the side fixed to the rotational shaft 11 is aligned with an extending direction of the rotational shaft 11 (herein after referred to as "direction of the rotational axis"). In the impeller G of this embodiment, the lateral sizes was the distance w between the ends on the side fixed to the rotational shaft 11 and the opposite side is 2.4 cm, and the size h for the height in the direction of the rotational shaft is 1.3 cm. While the size of the impeller 6 is optionally determined depending on the size of the stirring vessel 1, the lateral sizes w is preferably from ⅙ to ⅓ of the inner diameter of the stirring vessel 1.

The first screen member 7 is a substantially cylindrical member having an inner diameter somewhat larger than the diameter of the impeller 6 and extending in the direction of the rotational axis and is disposed so as to surround the impeller 6 in the inter-plate space 13. In this embodiment, the first screen member 7 has an inner diameter R1 of 2.7 cm and the size h1 for the height in the direction of the rotational axis of 2.5 cm.

Slits 15 as plural slurry passing holes are formed to the cylindrical peripheral wall of the first screen member 7. The width and the length of the slit 15, and the distance for the slits are properly determined depending on the particle size of the aggregate particles to be obtained. For example, in this embodiment intending to obtain aggregate particles of from 3 μm to 6 μm in volume average particle size, slits 15 each of 2 mm width and 17 mm length are formed each at 3 mm interval.

One end of the first screen member 7 in the direction of the rotational axis is fitted into the circular recess formed in the second cover plate 5. Further, the other end of the first screen member 7 is fitted into the circular recess formed in the first cover plate 4. This defines the position of the first screen member 7 to the first cover plate 4 and the second cover plate 5.

The second screen member 8 is a substantially cylindrical member having an inner diameter larger than the outer diameter of the first screen member 7 and extending in the direction of the rotational axis, and is disposed so as to surround the first screen member 7 in the inter-plate space 13. In this embodiment, the inner diameter R2 of the second screen member 8 is 3.7 cm and the size for the height of the second screen member 8 in the direction of the rotational axis is 2.5 cm which is identical with the size h1 for the height of the first screen member 7.

Slits 15 as plural slurry passing holes are formed penetrating the cylindrical peripheral wall of the second screen member 8 in the thickness direction like in the first screen member 7. One end of the second screen member 8 in the direction of the rotational axis is fitted into the circular recess formed in the second cover plate 5. The other end of the second screen member 8 is fitted into the circular recess formed in the first cover plate 4. This defines the position of the second screen member 8 to the first cover plate 4 and the second cover plate 5.

The third screen member 9 is a substantially cylindrical member having an inner diameter larger than the outer diameter of the second screen member 8 and extending in the direction of the rotational axis and is disposed so as to surround the second screen member 8 in the inter-plate space 13. In this embodiment, the inner diameter R3 of the third screen member 9 is 4.6 cm, and the size for the height of the third screen member 9 in the direction of the rotational axis is 2.5 cm which is identical with the size h1 for the height of the first screen member 7.

Slits 15 as plural slurry passing holes are formed penetrating the cylindrical peripheral wall of the third screen member 9 in the thickness direction like in the first screen member 7 and the second screen member 8. One end of the third screen member 9 in the direction of the rotational axis is fitted into the circular recess formed in the second cover plate 5. The other end of the third screen member 9 is fitted into the circular recess formed in the first cover plate 4. This defines the position of the third screen member 9 to the first cover plate 4 and the second cover plate 5.

The stirring section 3 described above is used being disposed in a state where it is dipped in the resin particle slurry 2 contained in the stirring vessel 1. The position for disposing the stirring section 3 in the stirring vessel 1 is properly determined depending on the kind of the resin particle slurry 2, the amount of the resin particle slurry 2, the size of the stirring vessel 1, etc. By properly setting the position for disposing the stirring section 3 in the stirring vessel 1, the entire resin particle slurry 2 can be stirred, the particle size distribution width can be narrowed, and the amount of bubbles to be generated can be reduced.

The position for the stirring section 3 is determined by properly setting the ratio (H/D) for the distance H between the liquid surface of the resin particle slurry 2 in the stirring vessel 1 and the upper end of the stirring blade 14 on the side facing the first cover plate 4 relative to the inner diameter D of the stirring vessel 1, and by properly setting the distance d between the bottom of the stirring vessel 1 and the surface of the second cover plate 5 on the side opposite to that facing the first cover plate 4.

Further, the top end speed of the stirring blade 14 of the impeller 6 (herein after also referred to as "top end speed of stirring blade") is properly determined depending on the kind of the resin particle slurry 2, the amount of the resin particle slurry 2, the size of the stirring vessel 1, etc. By properly setting the top end speed of the stirring blade, the resin particle slurry 2 can be stirred sufficiently while decreasing the amount of the bubbles to be generated.

When the impeller 6 of the stirring section 3 rotates in a state where the resin particle slurry 2 in which resin particles are dispersed in an aqueous medium is contained in the stirring vessel 1, the resin particle slurry 2 present above the slurry inlet hole 10 flows by way of the slurry inlet hole 10 in the direction of an arrow 16 and flows into the inter plate space 13. Further, the resin particle slurry 2 present inside of the first screen member 7 is discharged by the rotation of the impeller 6 to the outside in the radial direction of an imaginary circle present in a plane vertical to the rotational shaft of the impeller 6 (herein after simply referred to as "radial direction") with the rotational shaft 11 of the impeller 6 as a center. The discharged resin particle slurry 2 flows through the slits 15 formed in the first screen member 7, the slits 15 formed in the second screen member 8, and the slits 15 formed in the third screen member 9 successively, and is discharged from the inter-plate space 13.

The resin particle slurry 2 flowing out of the inter-plate space 13 does not contain a flowing component in the circumferential direction of the imaginary circle present in the plane vertical to the rotational shaft of the impeller 6. Accordingly, the resin particle slurry 2 flows out radially from the stirring section 3 outwardly in the radial direction and no vortex flow is generated in the resin particle slurry 2 when it collides against the inner wall surface of the stirring vessel 1.

As described above, according to the granulating apparatus 100, the resin particle slurry 2 can be provided with a shearing force by stirring the resin particle slurry 2 contained in the stirring vessel 1 under high speed rotation, and flowing the same through the slits 15 formed in the first to third screen members 7, 8, and 9. This can prevent excess aggregation of the resin particles to obtain aggregate particles of a small particle size and a narrow particle size distribution width.

Further, since the first to third screen members 7, 8, and 9 are disposed so as to surround the impeller 6, formation of the vortex flow by the resin particle slurry 2 flowing out of the stirring section 3 can be prevented, air is not interfused into the resin particle slurry 2, and macro bubbles which are large bubbles caused by continuous interfusion of the gas phase in contact with the fluid are not generated. Since this can decrease the amount of air interfused by the rotation of the impeller 6, interfusion of the bubbles to the aggregate particles during stirring can be prevented to improve the mechanical strength of the obtained aggregate particles.

Further, by the provision of the first to third screen members 7, 8, and 9, generation of the vortex flow can be prevented and the rotational speed of the impeller 6 can be decided with no consideration for the increase of the interfusion amount of the bubbles due to increase of the rotational speed. This can increase the sharing force that can be provided by the impeller 6 to the resin particle slurry 2, to obtain aggregate particles which are further reduced in the particle size and with narrow particle size distribution width.

While the three screen members 7, 8, and 9 are provided to the stirring section 3 in this embodiment, they are not restrictive and it may suffice that two or more screen members are provided. In a case where the number of the screen member is one or less, a vortex flow is formed by the resin particle slurry 2 flowing out of the stirring section 3, and the effect by the provision of the screen member, that is, the effect capable of decreasing the amount of the interfused air cannot be obtained. For decreasing the amount of air interfused by the rotation of the impeller 6, two or more screen members are necessary and it is more preferred to provide them by the number of three or more with a viewpoint of reliably preventing the interfusion of bubbles to the aggregate particles.

According to the granulating apparatus 100 of this embodiment, since the wave height of the resin particle slurry 2 can be set to 0 mm to 15 mm, the amount of the bubbles to be generated can be decreased to thereby decrease the amount of the air interfused into the aggregate particles. The wave height of the resin particle slurry 2 means herein a vertical distance between the liquid surface of the resin particle slurry 2 and a portion nearest to the liquid surface of the resin particle slurry 2 for the portion where the bubbles are not generated. The distance can be measured by using, for example, a scale. Whether the bubbles are generated or not can be recognized by observing the liquid surface of the resin particle slurry 2. In a case where the bubbles are not generated at all, the wave height is 0 mm.

The constitution of the stirring section 3 is not restricted to that described above and commercial products or those described in Patent Document can be used. As the commercial products of the stirring section, New Generation Mixer NGM-1.5TL (manufactured by Beryu Co., Ltd.), etc. can be used for instance. For example, as the stirring section described in the Patent Document, those described, for example, in JP-A 2004-8898 can be mentioned.

The resin particles contained in the resin particle slurry 2 aggregated by the granulating apparatus 100 as described above can be manufactured in accordance with the known granulating method for synthetic resin and they are preferably particles manufactured by a high pressure homogenizer method. In the present specification, the high pressure homogenizer method is a method of granulating a synthetic resin by using a high pressure homogenizer and the high pressure homogenizer is an apparatus for granulating particles under pressure.

Figure 3:
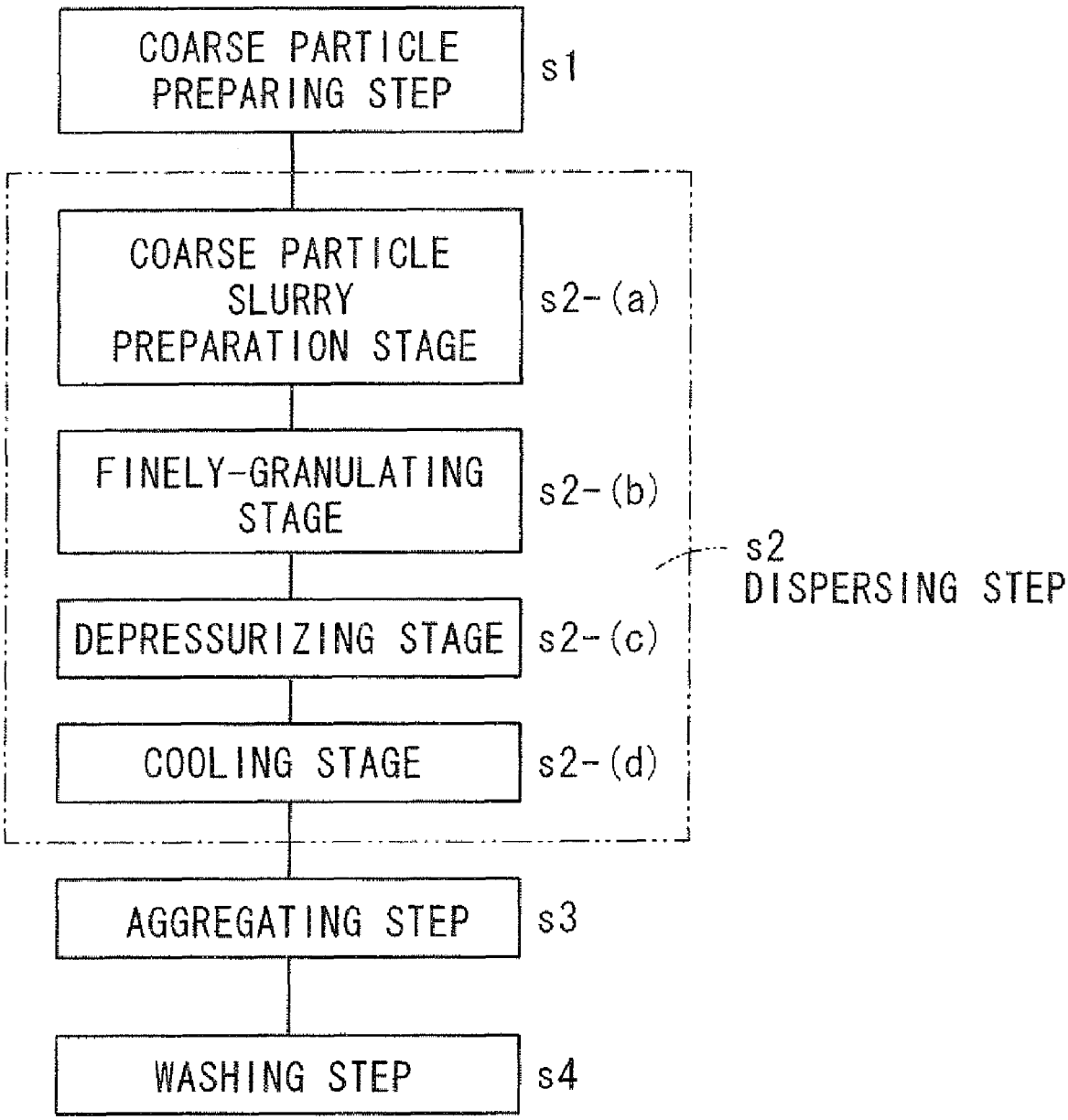
FIG. 3 is a flow chart schematically showing the method of manufacturing aggregate particles.

As the high pressure homogenizer, commercial products and those described in Patent Document, etc. are known. Commercial products of the high pressure homogenizer include, for example, chamber type high pressure homogenizers such as Microfluidizer (trade name of products, manufactured by Microfluidics Co.), Nanomizer (trade name of products, manufactured by Nanomizer Co.), Altimizer (trade name of products, manufactured by Sugino Machine Ltd.), high pressure homogenizer (trade name of products, manufactured by Rannie Co.), high pressure homogenizer (trade name of products, manufactured by Sanmaru Machinery Kogyo Co.), and high pressure homogenizer (trade name of products, manufactured by Izumi Food Machinery Co.). Further, the high pressure homogenizers described in the Patent Document include, for example, those described in International Publication WO03/059497. Among them, the high pressure homogenizer described in WO03/059497 is preferred. FIG. 3 shows an example of the method of manufacturing the resin particles by using the high pressure homogenizer described in WO03/059497.

FIG. 3 is a flow chart schematically showing the method of manufacturing aggregate particles. The method of manufacturing the aggregate particles shown in FIG. 3 includes a coarse particle preparing stage as step s1, a dispersing step as step s2, an aggregating step as step s3, and a washing step as step s4. In this embodiment, the dispersing step as step s2 includes a coarse particle slurry preparing stage in step s2-(*a*), a finely-granulating stage in step 2-(*b*), a depressurizing stage in step 2-(*c*), and a cooling stage in step 2(*d*).

In this embodiment, the flocculant adding stage in step s3-(*a*) is carried out by using the granulating apparatus 100 shown in FIG. 1. Further, the finely-granulating stage in step 2-(*b*), a depressurizing stage in step 2-(*c*), and the cooling stage in step 2-(*d*) are carried out, for example, by using a high pressure homogenizer 21 shown in FIG. 4.

Figure 4:
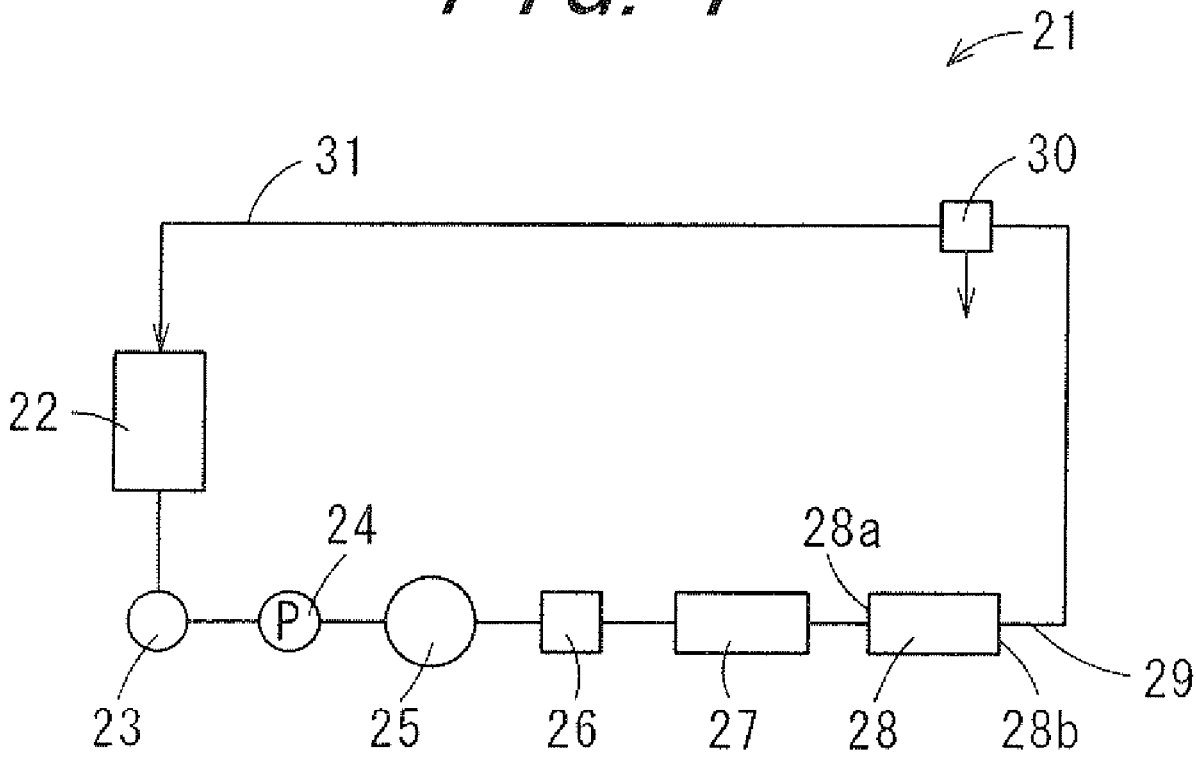
FIG. 4 is a system chart schematically showing the constitution of the high pressure homogenizer.

FIG. 4 is a system chart schematically showing the constitution of the high pressure homogenizer 21. The high pressure homogenizer 21 includes a tank 22, a delivery pump 23, a pressurizing unit 24, a heater 25, a pulverizing nozzle 26, a depressurizing module 27, a cooler 28, a pipeline 29, and a take-out port 30. In the high pressure homogenizer 21, the tank 22, the delivery pump 23, the pressurizing unit 24, the heater 25, the pulverizing nozzle 26, the depressurizing module 27, and the cooler 28 are connected in this order by way of the pipeline 29. In the system connected by the pipeline 29, the resin particle slurry after cooling by the cooler 28 may be taken out of the system from the take-out port 30, or the resin particle slurry after cooling by the cooler 28 may be returned again to the tank 22 and circulated repetitively in the direction of an arrow 31. In the dispersing step as step s2, the stage in which the coarse particle slurry passes through the pulverizing nozzle 26 is the finely-granulating stage in steps 2-(*b*) and the stage where the slurry passes through the depressurizing module 27 is the depressurizing stage in step s2-(*c*) and the stage of passing through the cooler 28 is the cooling stage in step s2-(*d*).

The tank 22 is a vessel-type member having an internal space and stores a coarse particle slurry as a slurry of a coarse particle containing a resin obtained in the coarse particle slurry preparing stage in steps 2-(*a*) (herein after occasionally simply referred to as "coarse particle" or "synthetic resin coarse particle"). The delivery pump 23 feeds the coarse particle slurry stored in the tank 22 to the pressurizing unit 24. The pressurizing unit 24 pressurizes the coarse particle slurry supplied from the delivery pump 23 and feeds the same to the heater 25. For the pressurizing unit 24, a plunger pump including a plunger and a pump driven by the plunger for suction and discharge can be used. The heater 25 heats the coarse particle slurry supplied from the pressurizing unit 24 and in a pressurized state.

For the heater 25, for example, those including not illustrated coiled (or spiral) pipeline and a heating section (not shown) can be used. The coiled pipeline is a member having a not illustrated flow channel at the inside, to which a pipe-like member for passing the coarse particle slurry therethrough is wound around in a coiled (or spiral)-shape. The heating section is disposed along the outer peripheral surface of the coiled pipeline and includes a pipeline in which steams, heat medium, etc. can pass through and a heat medium supply section for supplying steams, heat medium, etc. to the pipeline.

The heating medium supply section is, for example, a boiler. When particle-containing aqueous slurry is passed through the coiled pipeline in the heater 25, a centrifugal force and a shearing force are provided in a heated and pressurized state. By simultaneous exertion of the centrifugal force and the shearing force, turbulence is generated in the flow channel in a case where the particles are sufficiently small particles such as resin particles having a volume average particle size of from 0.3 to 2 μm, the particles undergo the effect of the turbulence and pass irregularly in which the frequency of collision between particles to each other increases remarkably to cause aggregation. On the other hand, in a case of coarse particles with the particle size of about 100 μm, since the particles are sufficiently large, they pass through near the inner wall surface of the flow channel in a stable state by a centrifugal force and less undergo the effect of the turbulence, so that aggregation less occurs.

The pulverizing nozzle 26 pulverizes the coarse particles into resin particles by passing the coarse particle slurry in a heated and pressurized state supplied from the heater 25 through the flow channel formed in the inside thereof. While a usual pressure proof nozzle capable of passing the liquid can be used for the pulverizing nozzle 26, a multiple nozzle having a plurality of flow channels can be used preferably. The flow channels of the multiple nozzle may be formed on coaxial circles with the axial center of the multiple nozzle as the center, or a plurality of flow channels may be formed substantially parallel with the longitudinal direction of the multiple nozzle. Specific examples of the multiple nozzle include those provided with one or plural, preferably, about 1 to 2 flow channels having an inlet diameter and an exit diameter of about 0.05 to 0.35 mm, as well as a length of from 0.5 to 5 cm. Further, a pressure proof nozzle in which flow channels are not formed linearly in the inside of the nozzle can also be used. Such a pressure proof nozzle includes, for example, that shown in FIG. 5.

Figure 5:
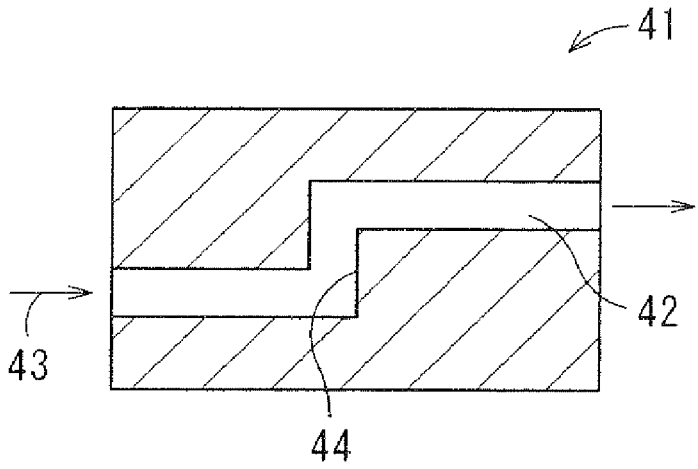
FIG. 5 is a cross sectional view schematically showing the constitution of a pressure proof nozzle.

FIG. 5 is a cross sectional view schematically showing the constitution of a pressure proof nozzle 41. The pressure proof nozzle 41 has a flow channel 42 at the inside thereof. The flow channel 42 is bent in a hook-like configuration and has at least one collision wall 44 against which the coarse particle slurry interfusing into the flow channel 4, in the direction of arrow 43 abuts. The coarse particle slurry collides against the collision wall 44 substantially at a right angle, by which the coarse particle is pulverized into resin particles further reduced in the diameter and discharged from the exit of the pressure proof nozzle 41. In the pressure proof nozzle 41, while the inlet diameter and the exit diameter are formed to an identical size, which is not restrictive but the exit diameter may be formed smaller than the inlet diameter. While the exit and the inlet are usually formed each in a true circle, this is not restrictive but it may be formed, for example, in a normal polygonal shape. The pressure proof nozzle may be disposed by one or in plurality.

For the depressurizing module 27, a multi-stage depressurizing apparatus as described in WO03/059497 is used preferably. The multi-stage depressurizing apparatus includes an inlet channel, an exit channel and a multi-stage depressurizing channel. The inlet channel is connected at one end with the pipeline 29 and at the other end with the multi-stage depressurizing channel and introduces a slurry containing the resin particles and in the heated and pressurized state into the multi-stage depressurizing channel. The multi-stage depressurizing channel is connected at one end with the inlet channel and the other end with the exit channel, and depressurizes the slurry in the heated and pressurized state introduced to the inside thereof by way of the inlet channel such that generation of bubbles by bumping (bubbling) does not occur. The multi-stage depressurizing channel includes, for example, a plurality of depressurizing members and a plurality of connection members. For the depressurizing member, a pipe-shaped member is used for instance. As the connection member, a ring-like seal member is used for instance. The multi-stage depressurizing channel is constituted by connecting a plurality of pipe-shaped members of different inner diameter with the ring-shaped seal members. For instance, they include a multi-stage depressurizing channel formed by connecting 2 to 4 pipe-like members A each having an identical inner diameter by ring-like seal members from the inlet channel to the exit channel, connecting a pipe-like member B having an inner diameter about twice as large as the next pipe-like member A by the number of one by a ring-shape seal member and, further, connecting about 1 to 3 pipe-like members C each having an inner diameter smaller by about 5 to 20% than that of the pipe-like member B by a ring-like seal members. When a slurry in a heated and pressurized state is passed through such a multistage depressurizing channel, the slurry can be depressurized to an atmospheric pressure or a pressurized state approximate thereto without causing bubbling. A heat exchange section for circulating a cooling medium or heating medium may be disposed to the periphery of the multi-stage pressurizing channel and may be cooled or heated at the same time with depressurization in accordance with the value of pressure added to the slurry. The exit channel is connected at one end to the multi-stage depressurizing channel and at the other end to the pipeline 29. A slurry to be depressurized by the multi-stage depressurizing channel is delivered to the pipeline 29. The multi-stage depressurizing apparatus may be constituted such that the inlet diameter is identical with the exit diameter, or it may be constituted such that the exit diameter is larger than the inlet diameter.

Figure 6:
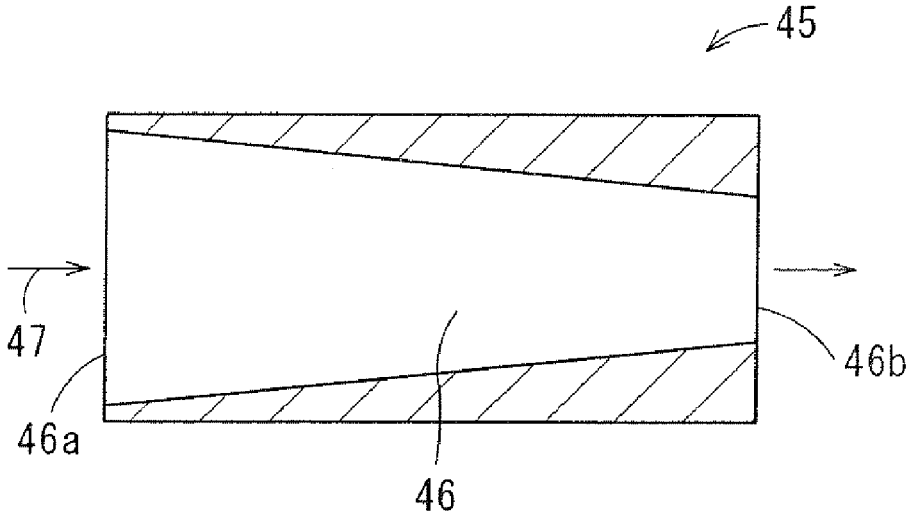
FIG. 6 is a cross sectional view in the longitudinal direction schematically showing the constitution of a depressurizing nozzle.

In this embodiment, the depressurization module 27 is not restricted to the multi-stage depressurizing apparatus having the constitution as described above, but a depressurizing nozzle can also be used for instance. FIG. 6 is a cross sectional view in the longitudinal direction schematically showing the constitution of a depressurizing nozzle 45. In the depressurizing nozzle 45, a flow channel 46 passing through the inside in the longitudinal direction is formed. The inlet 46*a* and the exit 46*b* of the flow channel 46 are respectively connected to the pipelines 29. The flow channel 46 is formed such that the inlet diameter is larger than the exit diameter. Further, in the flow channel 46 of this embodiments the cross section in the direction perpendicular to the direction of an arrow 47 which is a passing direction of the slurry is gradually decreased from the inlet 46*a* as it approaches the exit 46*b*, and the center of the cross section (axis) is present on one identical axis (axis for the depressurizing nozzle 45) parallel with the direction of the arrow 47. According to the pressurizing nozzle 45, the slurry in the pressurized and heated state is introduced from the inlet 46*a* into the flow channel 46, undergoes depressurization and is then discharged from the exit 46*b* to the pipeline 29. The multi-stage depressurizing apparatus or the depressurizing nozzle as described above may be provided by one or in plurality. In a case of disposing them in plurality, they may be disposed in series or parallel.

For the cooler 26, a usual fluid cooler having a pressure proof structure can be used and, for example, a cooler in which the slurry is cooled by providing a pipeline for circulating cooling water around the pipeline through which the slurry passes and circulating cooling water can be used. Among all, a cooler of a large cooling are a such as a bellows type cooler is preferred. Further, it is preferred to constitute such that the cooling gradient is decreased from the cooler inlet to the cooler exit (or so as to lower the cooling performance). Since this can further prevent re-aggregation of the pulverized resin particles, granulation of the coarse particles can be attained more efficiently and the yield of the resin particles is also improved. The cooler 28 may be disposed by one or in plurality. In a case of disposing the cooler in plurality, they may disposed in series or parallel. In a case of the serial arrangement, the cooler is disposed preferably such that the cooling performance is gradually lowered in the passing direction of the slurry. The slurry discharged from the depressurizing module 27, containing the resin particles and in the heated state is introduced, for example, from the inlet 28*a* connected to the pipeline 29 of the cooler 28 into the cooler 28, undergoes cooling at the inside of the cooler 28 having the cool ingredient, and is discharged from the exit 28*b* of the cooler 28 to the pipeline 29.

The high pressure homogenizer 21 is commercially available. Specific examples can include, for example, NANO3000 (trade name of products; manufactured by Beryu Co., Ltd). According to the high pressure homogenizer 21, a coarse particle slurry stored in the tank 22 is introduced into the pulverizing nozzle 26 in the heated and pressurized state to pulverize the coarse particle into resin particles, the resin particle slurry in the heated and pressurized state discharged from the pulverizing nozzle 26 are introduced into the depressurizing module 27 and depressurized so as not to cause bubbling, the slurry of the resin particles in the heated state discharged from the depressurizing module 27 isintroduced into the cooler 28 and cooled therein to obtain a slurry of resin particles. The slurry of the resin particles is discharged from the takeout port 30, or circulated again to the tank 22 and applied with the same pulverizing treatment.

[Coarse Particle Preparing Step]

In this step, a coarse particle of a synthetic resin is prepared. In this case, the synthetic resin may also contain one or more of additives for use in synthetic resin. The coarse particle of the synthetic resin can be manufactured, for example, by pulverizing a solidilicates of kneaded material containing synthetic resin and, optionally, one or more additives for use in the synthetic resin.

The synthetic resin is not particularly restricted so long as the synthetic resin can be granulated in a molten state, and includes, for example, polyvinyl chloride, polyvinyl acetate, polyethylene, polypropylene, polyester, polyamide, styrenic polymer, (meth)acrylic resin, polyvinyl butyral, silicone resin, polyurethane, epoxy resin, phenol resin, xylene resin, rosin-modified resin, terpene resin, aliphatic hydrocarbon resin, cycloaliphatic hydrocarbon resin, and aromatic petroleum resin. The synthetic resin may be used alone or two or more of them may be used in combination. Among them, polyester, styrenic polymer, (meth)acrylic acid polymer, polyurethane, and epoxy resin capable of easily providing particles having a high surface smoothness by wet-granulation in an aqueous system are preferred.

As the polyester, known materials can be used including, for example, polycondensates of polybasic acids and polyhydric alcohols. As the polybasic acids, those known as monomers for polyesters can be used and include, for example, aromatic carboxylic acids such as terephthalic acid, isophthalic acid, phthalic acid anhydride, trimellitic acid anhydride, pyromellitic acid, and naphthalene carboxylic acid; aliphatic carboxylic acids such as maleic acid anhydride, fumaric acid, succinic acid, alkenyl succinic acid anhydride, and adipic acid; and methyl esterification products of such polybasic acids. The polybasic acid may be used alone or two or more of them may be used in combination. As the polyhydric alcohol, those known as monomers for polyester can be used and include, for example, aliphatic polyhydric alcohols such as ethyleneglycol, propylene glycol, butane diol, hexane diol, neopentyl glycol and glycerin; cycloaliphatic polyhydric alcohols such as cyclohexane diol, cyclohexane dimethanol, and hydrogenated bisphenol A; and aromatic diols such as ethylene oxide adduct of bisphenol A and propylene oxide adduct of bisphenol A. The polyhydric alcohol may be used alone or two or more of them may be used in combination.

The polycondensating reaction of the polybasic acid and the polyhydric alcohol can be carried out in accordance with a customary method, for example, carried out by contacting a polybasic acid and a polyhydric alcohol under the presence or absence of an organic solvent and under the presence of a polycondensation catalyst, which is completed when the acid value, the softening temperature and the like of the resultant polyester reach predetermined values. Thus, a polyester is obtained. In a case of using a methyl esterification product of a polybasic acid to a portion of the polybasic acid, de-methanol polycondensating reaction is conducted. In the polycondensating reaction, by properly changing the blending ratio, the reaction rate, etc. of the polybasic acid and the polyhydricalcohol, the carboxylic group contentat the terminal end of the polyester can be controlled, for example, and thus the physical property of the obtained polyester can be modified. Further, in a case of using trimellitic acid anhydride as the polybasic acid, a modified polyester is obtained also by easily introducing a carboxylic group in the main chain of the polyester. A self-dispersible polyester in water formed by bonding a hydrophilic group such as a carboxyl group or a sulfonic acidic group in the main chain and/or on the side chain of the polyester can also be used.

The styrenic polymer includes, for example, homopolymers of styrenic monomers, and copolymers of styrenic monomers and monomers copolymerizable with the styrenic monomers. The styrenic monomer includes, for example, styrene, o-methylstyrene, ethylstyrene, p-methoxystyrene, p-phenyl styrene, 2,4-dimethyl styrene, p-n-octylstyrene, p-n-decyl styrene and p-n-dodecyl styrene. The monomer copolymerizable with the styrenic monomer includes (meth) acrylates such as methyl (meth)acrylate, ethyl (meth)acrylate, propyl (meth)acrylate, butyl (meth)acrylate, isobutyl (meth)acrylate, n-octyl(meth)acrylate, dodecyl (meth)acrylate, 2-ethylhexyl (meth)acrylate, stearyl (meth)acrylate, phenyl (meth)acrylate, and dimethyl aminoethyl (meth)acrylate; (meth)acrylic monomers such as acrylonitrile, methacrylamide, glycidyl methacrylate, N-methylol acrylamide, N-methylol methacrylamide, and 2-hydroxyethyl acrylate; vinyl ethers such as vinylmethyl ether, vinylethyl ether, and vinyl isobutyl ether; vinyl ketones such as vinyl methyl ketone, vinyl hexyl ketone, and methyl isopropenyl ketone; and N-vinyl compounds such as N-vinyl pyrrolidone, N-vinyl carbazol, and N-vinyl indole. The styrenic monomer and the monomer copolymerizable with the styrenic monomer can be used each alone or two or more of them can be used in combination respectively.

The (meth)acrylic resin includes, for example, homopolymers of (meth)acrylates and copolymers of (meth)acrylate and monomers copolymerizable with the (meth)acrylates. (Meth)acrylates identical with those described above can be used. The monomers copolymerizable with the (meth)acrylates include, for example, (meth)acrylic monomers, vinyl ethers, vinyl ketones, and N-vinyl compounds. The monomers identical with those describe above can be used. As the (meth)acrylic resin, acidic group-containing acrylic resins can also be used. The acidic group containing acrylic resin can be produced, for example, by using an acrylic resin monomer containing an acidic group or hydrophilic group and/or a vinylic monomer having an acidic group or a hydrophilic group in combination upon polymerizing an acrylic resin monomer or an acrylic resin monomer and a vinylic monomer. Known acrylic resin monomers can be used and they include, for example, acrylic acid which may have a substituent, methacrylic acid which may have a substituent, acrylate which may have a substituent, and methacrylate which may have a substituent. The acrylic resin monomers may be used each alone or two or more of them may be used in combination. Known vinylic monomer can be used and they include, for example, styrene, α-methyl styrene, vinyl bromide, vinyl chloride, vinyl acetate, acrylonitrile, and methacryl nitrile. The vinylic monomers may be used each alone or two or more of them may be used in combination. Polymerization of the styrenic polymer and (meth) acrylic resin is carried out generally by using a radical initiator by solution polymerization, suspension polymerization, emulsification polymerization, and the like.

Polyurethane is not particularly restricted and, for example, acidic group or basic group-containing polyurethanes can be used preferably. The acidic group or basic group-containing polyurethanes can be used in accordance with known methods. For example, an acidic group or basic group-containing diol, polyol, and polyisocyanate may be put to addition polymerization. The acidic group or basic group-containing diol includes, for example, dimethylol propionic acid and N-methyldiethanol amine. The polyol includes, for example, polyether polyol such as polyethylene glycol, polyester polyol, acrylopolyol, and polybutadiene polyol. The polyisocyanate includes, for example, tolylene diisocyanate, hexamethylene diisocyanate, and isophorone diisocyanate. The ingredients described above may be used each alone or two or more of them may be used in combination.

While the epoxy resin is not particularly restricted, acidic group or basic group-containing epoxy type resins can be used preferably. The acidic group or basic group-containing epoxy resin can be produced, for example, by addition or addition polymerization of a polyvalent carboxylic acid such as adipic acid or trimellitic acid anhydride, or an amine such as dibutyl amine or ethylene diamine to the epoxy resin as a base.

In a case of using the finally obtained aggregate particles as a toner, the polyester is preferred among the synthetic resins described above. Since the polyester has excellent transparency and can provide aggregate particles with good powder fluidity, low temperature fixing property, and secondary color reproducibility, it is suitable to a binder resin for use in color toner. Further, the polyester and the acrylic resin may be used by grafting. Further, among the synthetic resins described above, synthetic resins with the softening temperature of 150° C. or lower are preferred in view of easy conduction of the granulating operation to resin particles, kneading property of the additives to the synthetic resin and more uniform shape and the size of the particle resins. The synthetic resins with the softening temperature of 60 to 150° C. are particularly preferred. Among them, synthetic resins having weight average molecular weight of 5,000 to 500,000 are preferred. The synthetic resins may be used each alone or two or more different resins may be used in combination. Further, also for an identical resin, a plurality kind of resins different partially or entirely in the molecular weight, monomer composition and the like can be used.

In the invention, a self-dispersible resin may also be used as the synthetic resin. The self-dispersible resin is a resin having a hydrophilic group in the molecule and having a dispersibility to liquid such as water. The hydrophilic group includes, for example, —COO— group, —$SO_3$— group, —CO— group, —OH group, —$OSO_3$— group, —$PO_3H_2$— group, —$PO_4$— group, and salts thereof. Among them, anionic hydrophilic groups such as —COO— group, and —$SO_3$— group are particularly preferred. The self-dispersible resin having one or more such hydrophilic groups is dispersed in water without using a dispersant or by merely using an extremely small amount of a dispersant. While the amount of the hydrophilic groups containing the self-dispersible resin is not particularly restricted, it is preferably from 0.001 to 0.050 mol and more preferably, from 0.005 to 0.030 mol based on 100 g of the self-dispersible resin. The self-dispersible resin can be produced, for example, by bonding a compound having a hydrophilic group and an unsaturated double bond (herein after referred to as "hydrophilic group-containing compound") to the resin. Bonding of the hydrophilic group-containing compound to the resin can be conducted in accordance with the method such as graft polymerization or block polymerization. Further, the self-dispersible resin can also be produced by polymerizing a hydrophilic group-containing compound or a hydrophilic group-containing compound and a compound copolymerizable therewith.

The resin to which the hydrophilic group-containing compound is bonded includes, for example, styrenic resins such as polystyrene, poly-α-methyl styrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers, styrene-methacrylate copolymers, styrene-acrylate-methacrylate copolymers, styrene-α-methyl chloroacrylate copolymers, styrene-acrylonitrile-acrylate copolymers, and styrene-vinylmethyl ether copolymers; (meth)acrylic resins; polycarbonate; polyesters; polyethylene; polypropylene; vinyl polychloride; epoxy resins; urethane-modified epoxy resins; silicone-modified epoxy resins; rosin-modified maleic acid resins; ionomer resins; polyurethane; silicone resins; ketone resins; ethylene-ethyl acrylate copolymers; xyrene resins; polyvinyl butyral; terpene resins; phenol resins; aliphatic hydrocarbon resins; and cycloaliphatic hydrocarbon resins.

The hydrophilic group-containing compound includes, for example, unsaturated carboxylic acid compounds and unsaturated sulfonic acid compounds. The unsaturated carboxylic acid compounds include, for example, unsaturated carboxylic acids such as (meth)acrylic acid, crotonic acid, and isochrotonic acid; unsaturated dicarboxylic acids such as maleic acid, fumaric acid, tetra hydrophthalic acid, itaconic acid, and citraconic acid; acid anhydrides such as maleic acid anhydride and citraconic acid anhydride; alkyl esters, dialkyl esters thereof, alkali metal salts thereof, alkaline earth metal salts thereof, and ammonium salts thereof. As the unsaturated sulfonic acid compound, for example, styrene sulfonic acids, sulfoalkyl (meth)acrylates, and metal salts and ammonium salts thereof can be used. The hydrophilic group-containing compounds may be used each alone or two or more of them may be used in combination. Further, as the monomer compounds other than the hydrophilic group-containing compound, sulfonic acid compounds can be used, for example. The sulfonic acid compound includes, for example, sulfoisophthalic acid, sulfoterephthaltcacid, sulfophthalicacid, sulfosuccinicacid, sulfobenzoic acid, sulfosalicylic acid, and metal salts or ammonium salts thereof.

In the synthetic resin used in the invention, one or more usual additives for use in a synthetic resin may be contained. Specific examples of the additive for use in the synthetic resin include, for example, various shapes (granular, fibrous, or flaky shape) of inorganic fillers, colorants, antioxidants, release agents, antistatics, charge controllers, lubricants, heat stabilizers, flame retardants, anti-dripping agents, UV-absorbents, light stabilizers, light screening agents, metal inactivators, antiaging agents, slipping agents, plasticizers, impact strength improvers, and compatibilizing agents.

In a case of using the finally obtained aggregate particles as a toner, a colorant, a release agent, a charge controller, etc. are preferably contained in the synthetic resin. The colorant is not particularly restricted and, for example, organic dyes, organic pigments, inorganic dyes, and inorganic pigments can be used.

The black colorant includes, for example, carbon black, copper oxide, manganese dioxide, aniline black, activated carbon, non-magnetic ferrite, magnetic ferrite, and magnetite.

The yellow colorant includes, for example, chrome yellow, yellow zinc, cadmium yellow, yellow iron oxide, mineral fast yellow, nickel titanium yellow, navel yellow, naphthol yellow S, hansa yellow G, hansa yellow 10G benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138.

The orange colorant includes, for example, red chrome yellow, molybdenum orange, permanent orange GTR, pyrazolone orange, Vulkan orange, Indanthrene brilliant orange RK, benzidine orange G, Indanthrene brilliant orange GK, C.I. pigment orange 31, and C.I. pigment orange 43.

The red colorant includes, for example, red iron oxide, cadmium red, minimum, mercury sulfide, cadmium, permanent red 4R, Lithol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

The purple colorant includes, for example, manganese purple, fast violet B, and methyl violet lake.

The blue pigment includes, for example, Prussian blue, cobalt blue, alkali blue lake, Victoria blue lake, phthalocyanine blue, nonmetal phthalocyanine blue, phtalocyanine blue partially chloride, fast sky blue, Indanthrene blue BC, C.I. pigment blue 15, C.I. pigment blue 15:2, C.I. pigment blue 15:3, C.I. pigment blue 16, and C.I. pigment blue 60.

The green pigment includes, for example, chrome green, chrome oxide, pigment green B, malachite green lake, final yellow-green G, and C.I. pigment green 7.

The white pigment includes, for example, zinc powder, titanium oxide, antimony white, and compounds such as zinc sulfide.

Colorants may be used each alone or two or more colorants of different colors may be used in combination. Further, also for the colorants of an identical color, two or more of them may be used in combination. While the content of the colorant in the resin particles is not particularly restricted, it is preferably from 0.1 to 20% by weight, and more preferably, from 0.2 to 10% by weight based on the entire amount of the resin particles.

Also the release agent is not particularly restricted and includes, for example, petroleum type waxes such as paraffin wax, and derivatives thereof and microcrystalline wax and derivatives thereof, hydrocarbon type synthesis waxes such as Fischer-Tropsch wax and derivatives thereof, polyolefin wax and derivatives thereof, low molecular weight polypropylene wax and derivatives thereof, polyolefin type polymer wax (low molecular polyethylene wax, etc.) and derivatives thereof, plant type waxes such as carnauba wax and derivatives thereof, rice wax and derivatives thereof, Candelilla wax and derivatives thereof, and wood wax, animal type waxes such as bee wax and whale wax, oil and fat type synthetic waxes such as aliphatic acid amide and esters of phenol and fatty acid, long chained carboxylic acid and derivatives thereof, long chained alcohols and derivatives thereof, silicone type polymers, and higher fatty acids. The derivatives include oxides, block copolymers of vinylic monomers and waxes, and grafting modification products of vinylic monomers and waxes. Among them, waxes having a melting point of a liquid temperature or higher of a water soluble dispersion stabilizer aqueous solution in the dispersing step are preferred. While the content of the release agent in the resin particles is not particularly restricted and can be selected properly from a wide range, it is preferably from 0.2 to 20% by weight based on the entire amount of the resin particles.

Also the charge controller is not particularly restricted and those for positive charge control and negative charge control can be used. The charge controller for positive charge control includes, for example, basic dye, quaternary ammonium salt, quaternary phosphonium salt, aminopyrine, pyrimidine compounds, polynuclear polyamino compound, aminosilane, nigrosine dye and derivative thereof, triphenyl methane derivatives, guanidine salts, and amidine salts. The charge controller for negative charge control includes, oil soluble dyes such a soil black and spilon black, metal containing azo compounds, azo complex dyes, naphthenic acid metal salts, metal complexes and metal salts of salicylic acid and derivatives thereof (metal including chromium, zinc, zirconium, etc.), fatty acid soaps, long chained alkyl carboxylic acid salts, and resin acid soap. The charge controllers may be used each alone or two or more of them may be used optionally in combination. While the content of the charge controller in the resin particle is not particularly restricted and can be selected properly from a wide range, it is preferably from 0.5 to 3% by weight based on the entire amount of the resin particles.

The kneaded product can be produced, for example, by dry mixing a synthetic resin and, optionally, one or more additives for use in a synthetic resin in a mixer and kneading the obtained powder mixture by a kneader. The kneading temperature is set to a melting temperature or higher of the binder resin (usually about 80 to 200° C., and preferably, about 100 to 150° C.).

known mixers can be used and include, for example, Henschel type mixing apparatus such as Henschel mixer (trade name of products, manufactured by Mitsui Mining Co.), super mixer (trade name of products, manufactured by Kawata Co.) Mechanomil (trade name of products, manufactured by Okada Seiko Co.), Ong mill (trade name of products, manufactured by Hosokawa Micron Co.), Hybridization System (trade name of products, manufactured by Nara Machinery Co., Ltd.), and Cosmo System (trade name of products, manufactured by Kawasaki Heavy Industry Co.)

Known kneaders can be used and general kneaders such as twin screw extruders, three rolls and laboplast mills can be used. More specifically, they include single shaft or double screw extruders such as TEM-100B (trade name of products, manufactured by Toshiba Machine Co.) and PCM-65/87, PCM-30 (each trade name of products, manufactured by Ikegai Co.) and open roll type kneaders such as Kneadex (trade name of products, manufactured by Mitsui Mining Co.). Among them, the open roll type kneaders are preferred. The additive for use in the synthetic resin such as a colorant may be used in the form of a master batch for uniformly dispersing the additive for use in the synthetic resin in the kneaded product. Further, two or more additives for use in the synthetic resin may be used in the form of composite particles. The composite particles can be produced by adding an appropriate amount of water, a lower alcohol or the like to two or more kinds of additives for the synthetic resin, granulating them by usual granulating machine such as high speed mill and then drying them. The master batch and the composite particle are mixed into a powder mixture upon dry mixing.

The solidification product is obtained by cooling the kneaded product. A powder pulverizing machine such as a cutter mill, feather mill, or jet mill is used for the pulverization of the solidification product. This can provide a coarse particle of the synthetic resin. The particle size of the coarse particle is not particularly restricted and it is preferably from 450 to 1,000 μm, more preferably, from 500 to 800 μm.

[Dispersing Step]

In the dispersing step in step s2, resin particles formed by finely granulating the coarse particles obtained in the coarse particle preparing step are dispersed in an aqueous medium to obtain a slurry of the resin particles. The dispersing step includes a coarse particle slurry preparing stage on step s2-(*a*), the finely granulating stage in step 2-(*b*), the depressurizing stage in step 2-(*c*), and the cooling stage in step 2-(*d*).

Coarse Particle Slurry Preparation Stage

In the coarse particle slurry preparing stage in step s2-(*a*), resin particles obtained in the coarse particle preparing step are dispersed in an aqueous medium to obtain a coarse particle slurry. The liquid to be mixed with the synthetic resin coarse particle is not particularly restricted so long as this is a liquid material not dissolving but capable of uniformly dispersing the synthetic resin coarse particle and, in view of the easy step control, disposal of liquid wastes after the entire steps and easy handling, water is preferred and water containing a dispersion stabilizer is more preferred. The dispersion stabilizer is preferably added to water before adding the synthetic resin coarse particle to water.

For the dispersion stabilizer, those customarily used in the relevant field can be used. Among them, water soluble polymeric dispersion stabilizers are preferred. The water soluble polymeric dispersion stabilizers include, for example, (meth) acrylic polymers, polyoxyethylene polymers, cellulose polymers, polyoxyalkylene alkylaryl ether sulfates, and polyoxyalkylene alkyl ether sulfates. (Meth) acrylic polymers contain one or more hydrophilic monomers selected from the following monomers: for example, acrylic monomers such as (meth)acrylic acid, α-cyano acrylic acid, α-cyanomethacrylic acid, itaconic acid, chrotonic acid, fumalic acid, maleic acid, and maleic acid anhydride; hydroxyl group-containing acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, and 3-chloro-2-hydroxypropyl methacrylate; ester monomers such as diethylene glycol monoacrylate, diethylene glycol monomethacrylate, glycerin monoacrylate, and glycerin monomethacrylate; vinyl alcohol monomers such as N-methylol acrylamide and N-methylol methacrylamide; vinyl alkyl ether monomers such as vinyl methyl ether, vinylethyl ether, and vinyl propyl ether; vinylalkyl ester monomers such as vinyl acetate, vinyl propionate, and vinylbutylate; aromatic vinylic monomers such as styrene, α-methylstyrene, and vinyl toluene; amide monomers such as acrylamide, methacrylamide, diacetone acrylamide, and methylol compounds thereof; nitrile monomers such as acrylonitrile and methacrylonitrile; acid chloride monomers such as acrylic acid chloride, and methacrylic acid chloride; vinylnitrogen-containing heterocyclic monomers such as vinyl pyridine, vinyl pyrrolidone, vinyl imidazole, and ethyleneimine; and crosslinkable monomers such as ethylene glycol dimethacrylate, diethylene glycol dimethacrylate, arylmethacrylate, and divinyl benzene.

Polyoxyethylene polymers include, for example, polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene lauryl phenyl ether, polyoxyethylene stearyl phenyl ester, and polyoxyethylene nonyl phenyl ester.

Cellulose polymers include, for example, methyl cellulose, hydroxylethyl cellulose, and hydroxypropyl cellulose.

Polyoxyalkylene alkylaryl ether sulfates include, for example, sodium polyoxyethylene lauryl phenyl ether sulfate, potassium polyoxyethylene lauryl phenyl ether sulfate, sodium polyoxyethylene nonylphenyl ether sulfate, sodium polyoxyethylene oleylphenyl ether sulfate, sodium polyoxyethylene cetylphenyl ether sulfate, ammonium polyoxyethylene laurylphenyl ether sulfate, ammonium polyoxyethylene nonylphenyl ether sulfate, and ammonium polyoxyethylene oleylphenyl ether sulfate.

Polyoxy alkylene alkyl ether sulfates include, for example, sodium polyoxyethylene lauryl ether sulfate, Potassium polyoxyethylene lauryl ether sulfate, sodium polyoxyethylene oleyl ether sulfate, sodium polyoxyethylene cetyl ether sulfate, ammonium polyoxyethylene lauryl ether sulfate, and ammonium polyoxyethylene oleyl ether sulfate.

The dispersion stabilizers may be used each alone or two or more of them may be used in combination. Further, when the slurry of the resin particles obtained by using the anionic dispersant to be described later as the dispersion stabilizer is used as it is for the production of the aggregate particles, addition of the anionic dispersant in the aggregating step for the manufacturing method of the aggregate particles can be saved. The addition amount of the dispersion stabilizer is not particularly restricted but it is preferably from 0.05 to 10% by weight and, more preferably, from 0.1 to 3% by weight based on the coarse particle slurry.

For the coarse particle slurry, a viscosity improver, a surfactant, etc. may also be added together with the dispersion stabilizer. The viscosity improver is effective, for example, to further granulation of the coarse particles. The surfactant can further improve, for example, the dispersibility of the synthetic resin coarse particle to water.

As the viscosity improver, polysaccharide type viscosity improvers selected from synthetic polymeric polysaccharides and natural polymeric polysaccharides are preferred. As the synthetic polymeric polysaccharides, known materials can be used and include, for example, cationified cellulose, hydroxyethyl cellulose, starch, ionized starch derivatives, and block copolymers of starch and a synthesis polymer. The natural polymeric polysaccharides include, for example, hyaluronic acid, carrageenan, locust be an gum, xanthane gum, guar gum, and gellan gum. The viscosity improvers may be used each alone or two or more of them may be used in combination. While the addition amount of the viscosity improver is not particularly restricted, it is preferably from 0.01 to 2% by weight based on the entire amount of the coarse particle slurry.

The surfactants include, for example, sulfosuccinate salts such as disodium lauryl sulfosuccinate, disodium lauryl polyoxyethylene sulfosuccinate, disodium polyoxyethylene alkyl (C12-C14) sulfosuccinate, disodium polyoxyethylene lauloyl ethanolamide sulfosuccinate, and sodium dioctyl sulfosuccinate. The surfactants may be used each alone or two or more of them may be used in combination. While the addition amount of the surfactant is not particularly restricted, it is preferably from 0.05 to 0.2% by weight based on the entire amount of the coarse particle slurry.

The synthetic resin coarse particles and the liquid are usually mixed by using a usual mixer, thereby obtaining a coarse particle slurry. While there is no particularly restriction on the addition amount of the synthetic resin coarse particles to the liquid, it is preferably from 3 to 45% by weight and more preferably, from 5 to 30% by weight based on the total amount or the synthetic resin coarse particle and the liquid.

Further, while mixing of the synthetic resin coarse powder and water may be conducted under heating or under cooling, it is usually conducted at a room temperature. Mixers include, for example, mixing apparatus such as MHD 200 (trade name of products, manufactured by IKA Japan Co.), Megatoron (trade name of products, manufactured by Central Scientific Commerce, Inc.) conti-TDS (trade name of products, manufactured by Dalton), and Flush blend (trade name of products, manufactured by Techno Support Ltd.) While the thus obtained coarse particle slurry may be served as it is for the finely-granulating stage, a usual pulverization treatment may be applied as a pretreatment to pulverize the synthetic coarse particle to a particle size, preferably, of about 100 μm and more preferably, 100 μm or less. The pulverization treatment as the pretreatment is conducted, for example, by passing the coarse particle slurry at high pressure in a usual pressure proof nozzle.

(Finely-Granulating Stage)

In the finely-granulating stage in step s2-(*b*), the coarse particle slurry obtained in the coarse particle slurry preparing stage is pulverized under heating and pressure to obtain an aqueous slurry of resin particles. For the heating and pressurization of the coarse particle slurry, the pressurizing unit 24 and the heater 25 in the high pressure homogenizer 21 are used. For the pulverization of the coarse particle, the pulverizing nozzle 26 in the high pressure homogenizer 21 is used. While the pressurizing and heating condition for the coarse particle slurry is not particularly restricted, it is preferably pressurized to 50 to 250 MPa and heated to 50° C. or higher and, more preferably, it is pressurized to 50 to 250 MPa and heated to the melting point or higher of the synthetic resin contained in the coarse particle and, particularly preferably, it is pressurized to 50 to 250 MPa and heated to the melting point to Tm+25° C. (Tm: ½ softening temperature in the flow tester of synthetic resin) of the synthetic resin contained in the coarse particle. In a case where the coarse particle contains two or more kinds of synthetic resins, both the melting point and the ½ softening temperature in the flow tester of the synthetic resin are values for the synthetic resin having the highest melting point or ½ softening temperature. In a case where the pressure is less than 50 MPa, the shearing energy is decreased and the pulverization may not possibly be progressed sufficiently. In a case where it exceeds 250 MPa, a risk increases excessively in the actual production line which is not practical. The coarse particle slurry is introduced from the inlet to the inside of the pulverizing nozzle 26 for pulverization under the pressure and the temperature within the range described above. The aqueous slurry discharged from the exit of the pulverizing nozzle 26 contains, for example, resin particles and is heated to 60° C. to Tm+60° C. (Tm has the same meanings as described above) and pressurized to about 5 to 80 MPa.

(Depressurizing Stage)

In the depressurizing stage in step s2-(*c*), the aqueous slurry of the resin particles in a heated and pressurized state obtained in the finely-granulating stage is depressurized to an atmospheric pressure or a pressure approximate thereto being kept in such a state as not causing bubbling. For depressurization, a depressurizing module 27 in the high pressure homogenizer 21 is used. The aqueous slurry after completion of the depressurizing stage contains, for example, resin particles and is at a liquid temperature of about 60° C. to Tm+60° C. In the present specification, Tm is a softening temperature of the resin particles.

In the present specification, the softening temperature of the resin particles was measured by using a flowing characteristic evaluation apparatus (trade name of products: Flow Tester CFT-100C, manufactured by Shimadzu Corp.). In the flow characteristic evaluation apparatus (Flow Tester CFT-100C), it was set such that 1 g of the specimen (resin particle) was extruded from a die (nozzle: 1 mm diameter, 1 mm length) by applying a load of 10 kgf/cm$^2$ ($9.8\times10^5$ Pa), heating was conducted at a temperature elevation rate of 6° C. per min, the temperature at which one-half amount of the specimen was discharged from the die was determined and defined as a softening temperature.

Further, the glass transition temperature (Tg) of the synthetic resin was determined as described below By using a differential scanning calorimeter (trade name of products: DSC 220, manufactured by Seiko Instruments Inc.), 1 g of the specimen (carboxyl group-containing resin or water soluble resin) was heated at a temperature elevation rate of 10° C. per min according to JIS K 7121-1987 to measure a DSC curve. A temperature at an intersection between a line extended from a base line on the high temperature side of an endothermic peak corresponding the glass transition of the obtained DSC curve to the low temperature side and a tangential line drawn at a point to maximize the gradient to the curve from the rising part to the top of the peak was defined as the glass transition temperature (Tg).

(Cooling Stage)

In the cooling stage in step s2-(*d*), an aqueous slurry depressurized in the depressurizing stage at about a liquid temperature of 60° C. to Tm+60° C. (Tm has the same meaning as described above) was cooled to a slurry at about 20° C. to 40° C. For the cooling, the cooler 28 in the high pressure homogenizer 21 is used.

As described above, an aqueous slurry containing resin particles is obtained. The aqueous slurry may be aggregated as it is in the next aggregating step, or it may be aggregated by isolating the resin particles from the aqueous slurry, and the resin particles may be again slurrified and aggregated. For isolating the resin particles from the aqueous slurry, a usual separation apparatus such as filtration, centrifugation, and separation is used. In this manufacturing method, the particle size of the obtained resin particles can be controlled by properly controlling the temperature and/or pressure applied to the aqueous slurry upon passage through the pulverizing nozzle 26, the concentration of the coarse particle in the aqueous slurry, the number of cycles of pulverization. In the invention, for obtaining aggregate particles of an appropriate volume average particle size by aggregating the resin particles, each of the conditions is controlled such that the volume average particle size of the resin particles is 2 μm or less and more preferably, from 0.3 to 2 μm.

In the present specification, the volume average particle size and the coefficient of variation (CV value) are values determined as described below. A specimen for measurement was prepared by adding 20 mg of a specimen and 1 ml of sodium alkylether sulfate to 50 ml of an electrolyte (trade name of products: ISOTON-TI, manufactured by Beckman Coulter Inc.) and they were put to a dispersing treatment at an ultrasonic frequency of 20 kHz for 3 min by an ultrasonic dispersing apparatus (trade name of products: UPI-50, manufactured by STM Co.). The specimen for measurement was measured by using a particle size distribution measuring apparatus (trade name of products: Multisizer 3, manufactured by Beckman Coulter Inc.) under the condition of an aperture diameter of 20 μm and the number of particles measured of 50,000 counts to determine the volume average particle size and the standard deviation in the volume particle size distribution based on the volume particle size distribution of the specimen particles. The coefficient of variation (CV value (%)) was calculated according to the following equation:

$$\text{CV value}(\%)=(\text{standard deviation in the volume particle size distribution}/\text{volume average particle size})\times100$$

(Aggregating Step)

In the aggregating step in s3, a resin particle slurry is stirred by using the granulating apparatus 100 shown in FIG. 1 having a stirring section 3 including an impeller 6 as a stirring member and two or more screen members 7, 8, and 9 disposed so as to surround the impeller 6 in the stirring vessel 1 and formed with a plurality of slurry passing holes.

The aggregate particles are prepared under particle size control such that the volume average particle size thereof is preferably in a range of from 3 to 6 μm. The aggregate particles with the volume average particle size of from 3 to 6 μm, when used, for example as a toner, can stably produce high quality image excellent in the store stability under heating such as in a developer tank, having high concentration and high fineness, favorable in image reproducibility, and with no image failure.

In the aggregating step, the resin particles are aggregated by adding a flocculant for aggregating the resin particles and less soluble inorganic particles to the resin particle slurry as the aqueous slurry of the resin particles to obtain an aqueous slurry of the aggregate particles (herein after referred to as "aggregated particle slurry").

While the concentration of the resin particles in the resin particle slurry is not particularly restricted; it is preferably from 2 to 40% by weight and, more preferably, from 5 to 20% by weight based on the entire amount of the resin particle slurry. In a case where it is less than 2% by weight, the aggregating force of the resin particles is decreased possibly making it difficult for the particle size control. In a case where it exceeds 40% by weight, excess aggregation may possibly occur.

As the flocculant for aggregating the resin particles, monovalent salts, bivalent salts, trivalent salts, etc. can be used. The monovalent salts includes, for example, cationic dispersant such as alkyltrimethyl ammonium chloride, and inorganic salts such as sodium chloride, potassium chloride, and ammonium chloride. The bivalent salts include, for example, magnesium chloride, calcium chloride, zinc chloride, cupric chloride (II), magnetic sulfate, and manganese sulfate. The trivalent salts include, for example, aluminum chloride and ferric chloride (III). The dispersibility of the resin particles in the resin particle slurry is lowered by the addition of the flocculant as such salts. By flowing the resin particle slurry through the pipe-like pipe line in this state, aggregation of the resin particles proceeds smoothly with no troubles to obtain aggregate particles with less variation for the shape and the particle diameter.

Among the flocculants exemplified above, alkyltrimethyl ammonium chloride is preferred. Specific examples of alkyltrimethyl ammonium chloride include, for example, stearyl trimethyl ammonium chloride, tri(polyoxyethylene)stearyl ammonium chloride, and lauryl trimethyl ammonium chloride. The flocculant may be used alone or two or more of them may be used in combination.

The addition amount of the flocculent is not particularly restricted and properly selected from a wide range and it is preferably contained in the resin particle slurry at a ratio of 0.1% by weight to 5% by weight based on the entire amount of the resin particle slurry. In a case where the addition amount of the flocculant is less than 0.1% by weight, the performance of weakening the dispersibility of the resin particles becomes insufficient to possibly make aggregation of the resin particles insufficient. In a case where the addition amount of the flocculant exceeds 5% by weight, the dispersing effect of the flocculant is developed thereby possibly making the aggregation insufficient.

For the resin particle slurry, an anionic dispersant may also be added. The anionic dispersant is preferably added into the resin particle slurry in a case where the synthetic resin as the matrix ingredient of the resin particles is a resin other than the self-dispersible resin. The anionic dispersant improves the dispersibility of the resin particles in water. Accordingly, aggregation of the resin particles proceeds smoothly and occurrence of excess aggregation is prevented by adding the anionic dispersant to the resin particle slurry and, further, adding the cationic dispersant. The aggregate particles with a narrow particle size distribution width can be produced at good yield. The anionic dispersant may be added to the coarse particle slurry in a stage of preparing the coarse particle slurry.

As the anionic dispersant, known dispersants can be used and include, for example, sulfonic acid type an ionic dispersants, sulfate type an ionic dispersants, polyoxyethylene ether type anionic dispersants, phosphate type anionic dispersants, and polyacrylate salts. As the specific examples of the anionic dispersant, sodium dodecylbenzene sulfonate, sodium polyacrylate, polyoxyethylene phenyl ether, etc. can be used preferably. The anionic dispersants may be used each alone or two or more of them may be used in combination.

While the addition amount of the anionic dispersant is not particularly restricted, it is preferably from 0.1 to 5% by weight based on the entire amount of the resin particle slurry. In a case where it is less than 0.1% by weight, the dispersing effect for the resin particles by the anionic dispersant is insufficient to possibly cause excess aggregation. Even when it is added in excess of 5% by weight, the dispersing effect is not improved further and the viscosity of the resin particle slurry rather increases to lower the dispersibility of the resin particles. As a result excess aggregation may possibly occur.

In a case of using the flocculant and the anionic dispersant together, the ratio of using the flocculant and the anionic dispersant is not particularly restricted so long as it is used at a ratio of lowering the dispersing effect of the anionic dispersant by the use of the flocculant. However, in view of easy particle size control for the aggregate particles, easy occurrence of aggregation, prevention for the occurrence of excess aggregation, further narrowing of the particle size distribution width of the aggregate particles, etc., the anionic dispersant and the flocculant are used at a ratio, preferably, from 10:1 to 1:10, more preferably, from 10:1 to 1:3 and, particularly preferably, from 5:1 to 1:2 by weight ratio.

In the aggregating step, the flocculant, etc. as described above are added to the resin particle slurry. In the aggregating step, the flocculent, etc. may be added while stirring the resin particle slurry by the stirring section 3, or stirring may be conducted by the stirring section 3 after the addition of the flocculant, etc.

In this embodiment, after the addition of the flocculent to the resin particle slurry, the resin particle slurry is stirred under heating by the granulating apparatus 100. By stirring using the granulating apparatus 100 shown in FIG. 1, since the resin particle slurry is stirred uniformly with no interfusion of bubbles, involvement of bubbles during aggregation of particles is prevented. This can improve the mechanical strength of the aggregate particles. Further, aggregate particles with a small particle size and a narrow particle size distribution width can be obtained.

The stirring time by the granulating apparatus 100 is not particularly restricted and determined properly depending, for example, on the particle size of the resin particles and the particle size of the aggregate particles intended to be obtained, the concentration of the resin particle slurry, and the kind of the flocculant and the anionic dispersant to be used. For example, the stirring time by the stirring section 3 is preferably from 30 min to 180 min. The stirring time for the resin particle slurry may be changed properly in accordance with the extent of proceeding the aggregation.

Also the heating temperature of the resin particle slurry is not particularly restricted and determined properly for example, in accordance with the particle size of the resin particles and the particle size of the aggregate particles to be obtained, the concentration of the resin particle slurry, and the kind of the flocculant and the anionic dispersant to be used. The heating temperature of the resin particle slurry is preferably from 60° C. to 100° C. The heating temperature of the resin particle slurry may be changed properly depending on the extent of proceeding aggregation.

When the resin particles are aggregated by the aggregating step to obtain aggregate particles, the slurry containing the aggregate particles (herein after referred to as "aggregated particle slurry") is cooled to a room temperature and then the process goes to the washing step.

[Washing Step]

In the washing step s4, aggregate particles are separated from the aggregated particle slurry, washed and then dried to obtain aggregate particles. For the separation of the aggregate particles, usual solid liquid separation apparatus such as filtration, centrifugal separation, or decantation can be adopted. The aggregate particles are washed for removing not aggregated resin particles, the flocculant and the cationic dispersant, etc. Specifically, washing is conducted by using, for example, pure water at a conductivity of 20 μS/cm or less. The aggregate particles and pure water are mixed and washing with the pure water is repeated till the conductivity of the washing water left after separation of the aggregate particles from the mixture is lowered to 50 μS/cm or less. After the washing, the aggregate particles of the invention are obtained by drying.

The aggregate particles of the invention preferably have a volume average particle size of about 3 to 6 μm, uniform shape and particle size, and an extremely narrow particle size distribution width. For obtaining the aggregate particles of the invention with the volume average particle size of about 3 to 6 μm, it is important, for example, to make the processing time to an optimal time.

In the method of manufacturing the aggregate particles of this embodiment, a depressurizing state may be provided just aster the cooling stage in step s2-(*d*). The depressurizing stage is identical with the depressurizing stage in step s2-(*c*).

The aggregate particles manufactured by the method of manufacturing the aggregate particles described above are excellent in the mechanical strength and have small particle size and narrow particle size distribution width. Accordingly, when such aggregate particles are used as a toner, the chargebility, developability, and transferability of individual particles are uniform and images at high fineness can be formed, as well as such properties are maintained for a long time.

Example

The invention is to be described specifically referring to examples and comparative examples. In the followings, "parts" and "%" mean "parts by weight" and "% by weight" respectively unless otherwise specified.

Coarse Particle Slurry Preparation Example A 87.5 parts of a polyester resin (binder resin, glass transition temperature Tg: 60° C., softening temperature Tm: 110° C.), 1.5 parts of a charge controller (TRH; trade name of products manufactured by Hodcgaya Chemical Industry Co.), 3 parts of a polyester type wax (release agent, melting point: 85° C.), and 8 parts of a colorant (KET, BLUE 111) were mixed in a mixer (Henschel Mixer; trade name of products manufactured by Mitsui Mining Co.), and the obtained mixture was melted and kneaded by using a twin screw extruder (PCM-30; trade name of products manufactured by Ikegai Co.) at a cylinder temperature of 145° C. and number of barrel rotation of 300 rpm to prepare a molten kneaded product of the toner raw material. After cooling the molten kneaded product to a room temperature, it was coarsely pulverized by a cutter mill (VM-16; trade name of products manufactured by Seishin Enterprise Co. Ltd.), to prepare a coarse particle with a particle size of 100 μm or less. Using 40 g of the coarse particle, 13.3 g of xanthene gum, 4 g of sodium dodecylbenzenesulfonate (an ionic dispersant; Lunox S-100; trade name of manufactured by Toho Chemical Industrial Co., Ltd.), 0.67 g of a sulfosuccinic acid type surfactant (Aerol CT-1p; trade name of products, main ingredient: sodium salt of dioctyl sulfosuccinate, manufactured by Toho Chemical industrial Co., Ltd.) and the balance of water, 800 g of a coarse particle raw material was mixed and the obtained mixture was charged in a mixer (trade name of product: New Generation Mixer NGM-1.5 TL, manufactured by Beryu Co., Ltd.) stirred at 2,000 rpm for 5 min and then deaerated to obtain a coarse particle slurry of the coarse particle slurry preparation example A.

Coarse Particle Slurry Preparation Example B

A coarse particle slurry preparation example B was obtained in the same manner as in the coarse particle slurry preparation example A except for changing the amount of sodium dodecyl benzene sulfonate to 0.8 g.

Coarse Particle Slurry Preparation Example C

A coarse particle slurry preparation example C was obtained in the same manner as in the coarse particle slurry preparation example A except for changing the amount of sodium dodecyl benzene sulfonate to 40 g.

Coarse Particle Slurry Preparation Example D

A coarse particle slurry of a coarse particle slurry preparation example D was obtained in the same manner as in coarse particle slurry preparation example A except for using 26 g of a 30% aqueous solution of sodium polyoxyethylene polynuclear phenyl ether sulfate (Newcol 707-SN; trade name of products manufactured by Nippon Nyukazai Co. Ltd.) instead of sodium dodecyl benzene sulfonate.

Coarse Particle Slurry Preparation Example E

A coarse particle slurry of a coarse particle slurry preparation example E was obtained in the same manner as in coarse particle slurry preparation example A except for using 26 g of a 30% aqueous solution of polyoxyalkylene alkyl ether phosphate (Newcol 1000-FCP; trade name of products manufactured by Nippon Nyukazai Co. Ltd.) instead of sodium dodecyl benzene sulfonate.

Coarse Particle Slurry Preparation Example F

A coarse particle slurry of a coarse particle slurry preparation example F was obtained in the same manner as in coarse particle slurry preparation example A except for using 12.5 g of a 40% aqueous solution of sodium polyacrylate (Disrol H14-N; trade name of products manufactured by Nippon Nyukazai Co. Ltd.) instead of sodium dodecyl benzene sulfonate.

Coarse Particle Slurry Preparation Example G

A coarse particle slurry of a coarse particle slurry preparation example G was obtained in the same manner as in coarse particle slurry preparation example A except for using 0.8 g of sodium dodecyl benzene sulfonate and 20 g of a 30% aqueous solution of sodium polyoxyethylene polynuclear phenyl ether sulfate (Newcol 707-SN; trade name of products manufactured by Nippon Nyukazai Co. Ltd.).

Coarse Particle Slurry Preparation Example H

A coarse particle slurry of coarse particle slurry preparation example H was obtained in the same manner as in coarse particle preparation example A except for not adding sodium dodecyl benzene sulfonate.

Coarse Particle Slurry Preparation Example I

A coarse particle slurry of coarse particle slurry preparation example I was obtained in the same manner as in coarse particle preparation example A except for changing the amount of sodium dodecyl benzene sulfonate to 6 g.

Table 1 shows the anionic dispersant used in the coarse particle slurry preparation examples A to I and addition amounts thereof. In Table 1, the addition amount of the anionic dispersant is shown by the ratio (wt %) of the anionic dispersant in the coarse particle slurry.

TABLE 1

| Coarse particle slurry preparation example | Anionic dispersant | Addition amount (wt %) |
|---|---|---|
| A | Sodium dodecylbenzene sulfonate | 0.5 |
| B | Sodium dodecylbenzene sulfonate | 0.1 |
| C | Sodium dodecylbenzene sulfonate | 5.0 |
| D | Sodium polyoxyethylene polynuclear phenyl ether sulfate | 0.975 |
| E | Polyoxyalkylene alkyl ether phosphate | 0.975 |
| F | Sodium polyacrylate | 0.625 |
| G | Sodium dodecylbenzene sulfonate/ Sodium polyoxyethylene polynuclear phenyl ether sulfate | 0.85 |
| H | None | — |
| I | Sodium dodecylbenzene sulfonate | 0.75 |

Resin Particle Slurry Preparation Example A 800 g of a coarse particle slurry obtained in any one of the preparation examples of the coarse particle slurry preparation examples A to I was charged to a tank of a high pressure homogenizer (NANO 3000; trade name of products manufactured by Beryu Co., Ltd.), and circulated in the high pressure homogenizer for 30 min while keeping at a temperature of 143° C. and under a pressure of 210 MPa, to obtain a resin particle slurry of the resin particle slurry preparation example A. The high-pressure homogenizer used herein is the pulverizing high pressure homogenizer 21 shown in FIG. 3.

The coiled pipeline in the heater had a 4.0 mm coil inner diameter, a 40 mm coil radius (coil radius of curvature) and a number of coil turn of 50. As a pulverizing nozzle, a nozzle of a 0.4 mm nozzle length and formed with a channel of 0.09 mm passing through the longitudinal direction was used. As the depressurizing module, a pressure proof nozzle shown in FIG. 4 was used. The pressure proof nozzle had a nozzle length of 150 mm, a nozzle inlet diameter of 2.5 mm, and a nozzle exit diameter of 0.3 mm.

Resin Particle Slurry Preparation Example B

A resin particle slurry of the resin particle slurry preparation example B was obtained in the same manner as in the resin particle slurry preparation example A except for keeping the temperature at 162° C. and setting the pressure to 168 MPa and circulating the slurry for 20 min.

Resin Particle Slurry Preparation Example C

A resin particle slurry of the resin particle slurry preparation example C was obtained in the same manner as in the resin particle slurry preparation example A except for changing the slurry circulation time to 20 min.

Resin Particle Slurry Preparation Example D

A resin particle slurry of the resin particle slurry preparation example D was obtained in the same manner as in the resin particle slurry preparation example A except for circulating the slurry while keeping the temperature at 185° C. for 60 min.

Resin Particle Slurry Preparation Example E

A resin particle slurry of the resin particle slurry preparation example E was obtained in the same manner as in the resin particle slurry preparation example A except for circulating the slurry while keeping the temperature at 102° C. for 60 min.

Resin Particle Slurry Preparation Example F 800 g of a coarse particle slurry obtained in any one of the coarse particle slurry preparation examples A to I was charged in a double motion mixer (Cleamix CLM-2.2/3.7 W; trade name of products manufactured by Beryu Co., Ltd.) and treated for 30 min while keeping the temperature at 120° C., and setting the number of rotation of the rotor to 20,000 rpm, and at a number of rotation of the screen at 19,000 rpm, to obtain a resin particle slurry of the resin particle slurry preparation example F.

Table 2 shows the heating temperature, the pressurizing pressure, and the processing time in the resin particle slurry preparation examples A to F.

TABLE 2

| Resin particle slurry preparation example | Temperature (° C.) | Pressure (MPa) | Processing time (min) |
|---|---|---|---|
| A | 143 | 210 | 30 |
| B | 162 | 168 | 20 |
| C | 143 | 210 | 20 |

TABLE 2-continued

| Resin particle slurry preparation example | Temperature (° C.) | Pressure (MPa) | Processing time (min) |
|---|---|---|---|
| D | 185 | 210 | 60 |
| E | 102 | 210 | 60 |
| F | 120 | — | 30 |

Preparation Example A of Aggregated Particle Slurry 600 g of a resin particle slurry obtained in any one of the preparation examples of the resin particle slurry preparation examples A to F, and 30 g of a 20% aqueous solution of stearyl trimethyl ammonium chloride (Cotamin 86W; trade name of products manufactured by Kao Corp.) were charged in a granulating apparatus (New Generation Mixer NGM-1, 5TL: trade name of products manufactured by Beryu Co., L-Ld), stirred at 75° C., at 2,000 rpm for 30 min and then the temperature was elevated to 85° C. and they were further stirred for 2 hours. For aggregating not aggregated fine particles, 300 g of water was added after temperature elevation and cooled rapidly to a room temperature. After recovering aggregate particles by filtering the aggregated particle slurry obtained as described above and applying water washing for 5 times, the aggregate particles were dried at a hot blow of 75° C. to obtain aggregate particles of the preparation example A of the aggregated particle slurry.

The stirring section was located at a position where the distance H was 2.0 cm between the liquid surface of the resin particle slurry in the stirring vessel 1 and the upper end of the stirring blade on the side facing the first cover plate 4 and the distance d was 0.5 cm between the bottom of the stirring vessel 1 and the surface of the second cover plate 5 on the side opposite to the side facing the first cover plate 4. Further, the inner diameter D of the stirring vessel 1 was 10.5 cm and the speed at the top end of the stirring blade was 3.14 m/s. The wave height in this case was 10 mm.

Preparation Example B of Aggregated Particle Slurry 1,000 g of a resin particle slurry obtained in any one of the preparation examples of the resin particle slurry preparation examples A to F, and 200 g of a 20% aqueous solution of (polyoxyethylene)stearyl ammonium chloride (Catinal SPC-20AC; trade name of products manufactured by Toho Chemical Industry Co. Ltd.) were charged in a granulating apparatus (New generation Mixer NGM-1.5TL; trade name of products manufactured by Beryu Co., Ltd.). After stirring them at 75° C., 3,000 rpm for 30 min, 500 g of water was added and then stirred further for 2 hours while elevating the temperature to 85° C. Then, they were cooled rapidly to a room temperature. Aggregate particles were taken but by filtering the aggregated particle slurry obtained as described above and, after washing with water for 5 times, the aggregate particles were dried by a hot blow at 75° C. to obtain aggregate particles of the preparation example B of the aggregated particle slurry.

The stirring section is located at a position where the distance H is 6.0 cm between the liquid surface of the resin particle slurry in the stirring vessel 1 and the upper end of the stirring blade on the side facing the first cover 4 and the distance d was 0.5 cm between the bottom of the stirring vessel 1 and the surface of the second cover plate 5 on the side-opposite to the side facing the first cover plate 4. Further, the inner diameter D of the stirring vessel 1 was 11.0 cm and the speed at the top end of the stirring blade was 4.7 m/s. In this case, the wave height was 12 mm.

Preparation Example C of Aggregated Particle Slurry 1,000 g of a resin particle slurry obtained in any one of the preparation examples of the resin particle slurry preparation examples A to F, and 25 g of a 20% aqueous solution of (polyoxyethylene)stearyl ammonium chloride (Catinal SPC-20AC; trade name of products manufactured by Toho Chemical Industry Co. Ltd. were charged in a granulating apparatus (New generation Mixer NGM-1.5TL; trade name of products manufactured by Beryu Co., Ltd.). After stirring at 80° C., at 2,000 rpm, for 30 min, 500 g of water was added and then stirred further for 2 hours while elevating the temperature to 85° C. Then, they were cooled rapidly to a room temperature. Aggregate particles were taken out by filtering the aggregated particle slurry obtained as described above and, after washed with water for times, the aggregate particles were dried by a hot blow at 75° C. to obtain aggregate particles of the preparation example C of aggregated particle slurry. The location of the stirring section, the speed at the top end of the stirring blade, and the inner diameter D of the stirring vessel were identical with those in the preparation example A of the aggregated particle slurry.

Preparation Example D of Aggregated Particle Slurry

Aggregate particles of preparation example D of the aggregated particle slurry were obtained in the same manner as in the preparation example B of the aggregated particle slurry except for changing the heating time of the resin particle slurry to 85° C.

Preparation Example E of Aggregated Particle Slurry 1,000 g of a resin particle slurry obtained in any one of the preparation examples of the resin particle slurry preparation examples A to F, and 5 g of a 20% aqueous solution of (polyoxyethylene)stearyl ammonium chloride (Catinal SPC-20AC; trade name of products manufactured by Toho Chemical Industry Co. Ltd) were charged in a granulating apparatus (New generation Mixer NGM-1.5TL; trade name of products manufactured by Beryu Co., Ltd.) After stirring at 80° C., at 2,000 rpm for 50 min, 500 g of water was added and then stirred further for 2 hours while elevating the temperature to 85° C. Then, they were cooled rapidly to a room temperature. Aggregate particles were taken out by filtering the aggregated particle slurry obtained as described above and, after washing with water for 5 times, the aggregate particles were dried by a hot blow at 75° C. to obtain aggregate particles of the preparation example E of aggregated particle slurry. The location of the stirring section, the speed at the top end of the stirring blade and the inner diameter D of the stirring vessel were identical with those in the preparation example A of the aggregated particle slurry.

Preparation Example F of Aggregated Particle Slurry

Aggregate particles of preparation example F of the aggregated particle slurry were obtained in the same manner as in the preparation example B of the aggregated particle slurry except for using 250 g of (polyoxyethylene)stearyl ammonium chloride and changing the heating time of the resin particle slurry from 30 to 45 min.

Preparation Example G of Aggregated Particle Slurry 600 g of a resin particle slurry obtained in any one of the preparation examples of the resin particle slurry preparation examples A to F, and 20 g of sodium chloride (Guaranteed grade sodium chloride; trade name of products manufactured by Kishida Chemical Co. Ltd.) were charged in a granulating apparatus (New generation Mixer NGM-1.5 TL; trade name of products manufactured by Beryu Co., Ltd.). After stirring at 75° C., at 3,000 rpm for 30 min, 500 g of water was added and then stirred further for 2 hours while elevating the temperature to 85° C. Then, they were cooled rapidly to a room temperature. Aggregate particles were taken out by filtering the aggregated particle slurry obtained as described above and, after washing with water for 5 times, the aggregate particles were dried by a hot blow at 75° C. to obtain aggregate particles of the preparation example E of the aggregated particle slurry. The location of the stirring section, the speed at the top end of the stirring blade and the inner diameter D of the stirring vessel were identical with those in the preparation example B of the aggregated particle slurry.

Preparation Example H of Aggregated Particle Slurry

Aggregate particles of preparation example H of the aggregated particle slurry were obtained in the same manner as in the preparation example C of the aggregated particle slurry except for changing 20 g of sodium chloride to 6 g of calcium chloride (Guaranteed grade calcium chloride (anhydrous); trade name of products manufactured by Kishida Chemical Co.).

Preparation Example I of Aggregated Particle Slurry

Aggregate particles of the preparation example I of the aggregated particle slurry were obtained in the same manner as in the preparation example A of the aggregated particle slurry except for changing 30 g of the 20% aqueous solution of stearyl trimethyl ammonium chloride with 1.8 g of aluminum chloride hexahydrate (Guaranteed grade aluminum (III) (hexahydrate) trade name of products manufactured by Kishida Chemical Co.).

Preparation Example J of Aggregated Particle Slurry

Aggregate particles of the preparation example J of the aggregated particle slurry was obtained in the same manner as in the preparation example A of the aggregated particle slurry except for changing 30 g of the 20% aqueous solution of stearyl trimethyl ammonium chloride to 2 g of sodium chloride (Guaranteed grade sodium chloride; trade name of products manufactured by Kishida Chemical Co. Ltd.), and 5.5 g of calcium chloride (Guaranteed grade calcium chloride (anhydrous); trade name of products manufactured by Kishida Chemical Co. Ltd.).

Preparation Example K of Aggregated Particle Slurry

Aggregate particles of the preparation example K of the aggregated particle slurry was obtained in the same manner as in the preparation example A of the aggregated particle slurry except for changing the 20% aqueous solution of stearyl trimethyl ammonium chloride to a 20% aqueous solution of Polyquatanium-10 (Catinal HC-100; trade name of products manufactured by Toho Chemical Industrial Co., Ltd.).

Preparation Example L of Aggregated Particle Slurry

Aggregate particles of the preparation example L of the aggregated particle slurry was obtained in the same manner as in the preparation example A of the aggregated particle slurry except for changing 30 g of the 20% aqueous solution of stearyl trimethyl ammonium chloride to 300 g of a 20% aqueous solution of (polyoxyethylene)stearyl ammonium chloride (Catinal SPC-20AC; trade name of products manufactured by Toho Chemical Industrial Co., Ltd.).

Preparation Example M of Aggregated Particle Slurry 600 g of a resin particle slurry obtained in any one of the preparation example of the resin particle slurry preparation examples A to F, and 20 g of silicon dioxide (Silicon dioxide, 99.995+%; trade name of products manufactured by Sigma Aldrich Japan K.K.) were charged in a granulating apparatus (New generation Mixer NGM-1.5 TL; trade name of products manufactured by Beryu Co., Ltd.). After stirring them at 75° C., at 3,000 rpm for 30 min, 500 g of water was added and then stirred further for 2 hours while elevating the temperature to 85° C. Then, they were cooled rapidly to a room temperature. Aggregate particles were taken out by filtering the aggregated particle slurry obtained as described above and, after washing with water for 5 times, the aggregate particles were dried by a hot blow at 75° C. to obtain aggregate particles of the preparation example M of the aggregated particle slurry. The location of the stirring section, the speed at the top end of the stirring blade and the inner diameter D of the stirring vessel were identical with those in preparation example B of the aggregated particle slurry.

Preparation Example N of Aggregated Particle Slurry

Aggregate particles of the preparation example N of the aggregated particle slurry were obtained in the same manner as in Preparation Example A of the aggregated particle slurry except for detaching all the screen members of the stirring section. The wave height during stirring was 27 mm.

Preparation Example C of Aggregated Particle Slurry

Aggregate particles of the preparation example O of the aggregated particle slurry were obtained in the same manner as in the preparation example A of the aggregated particle slurry except for detaching the screen members other than the screen member nearest to the impeller among the screen members of the stirring section. The wave height during stirring was 18 mm.

Table 3 shows the flocculants used in the aggregated particle slurry preparation examples A to O, and the addition amount thereof, as well as the conditions for the granulating apparatus in the aggregated particle slurry preparation examples A to O. In the column for the granulating apparatus under the conditions for the granulating apparatus. A shows a case in which the position for the location of the stirring section, the inner diameter D of the stirring vessel and the speed at the top end of the stirring blade were identical with those in the aggregated particle slurry preparation example A, and B shows a case where they are identical with those in the aggregated particle slurry preparation example B. In Table 3, the addition amount of the flocculant is represented by the ratio (wt %) of the flocculant based on the entire amount of the slurry.

TABLE 3

| Aggregated slurry | Coagulant | | Condition for pelleting apparatus | | | | |
|---|---|---|---|---|---|---|---|
| preparation example | Material | Addition amount (wt %) | Temperature (° C.) | Number of Rotation (rpm) | Stirring time (min) | Stirring section | Number of screen members |
| A | Stearyl trimethyl ammonium chloride | 1.0 | 75 | 2000 | 30 | A | 3 |
| B | (Polyoxyethylene)stearyl ammonium chloride | 4.0 | 75 | 3000 | 30 | B | 3 |
| C | (Polyoxyethylene)stearyl ammonium chloride | 0.5 | 80 | 2000 | 30 | A | 3 |
| D | (Polyoxyethylene)stearyl ammonium chloride | 4.0 | 85 | 3000 | 30 | B | 3 |
| E | (Polyoxyethylene)stearyl ammonium chloride | 0.1 | 80 | 2000 | 50 | A | 3 |
| F | (Polyoxyethylene)stearyl ammonium chloride | 5.0 | 75 | 3000 | 45 | B | 3 |
| G | Sodium chloride | 3.3 | 75 | 3000 | 30 | B | 3 |
| H | Calcium chloride | 1.0 | 75 | 3000 | 30 | B | 3 |
| I | Aluminum chloride 6 hydrate | 0.3 | 75 | 2000 | 30 | A | 3 |
| J | Sodium chloride, Calcium chloride | 1.25 | 75 | 2000 | 30 | A | 3 |
| K | Polyquaternium-10 | 1.0 | 75 | 2000 | 30 | A | 3 |
| L | (Polyoxyethylene)stearyl ammonium chloride | 10.0 | 75 | 2000 | 30 | A | 3 |
| M | Silicon dioxide | 3.3 | 75 | 3000 | 30 | B | 3 |
| N | Stearyl trimethyl ammonium chloride | 1.0 | 75 | 2000 | 30 | A | 0 |
| O | Stearyl trimethyl ammonium chloride | 1.0 | 75 | 2000 | 30 | A | 1 |

Toners of examples, comparative examples, and reference examples were manufactured by using any one of the coarse particle slurry preparation examples A to I, any one of the coarse particle slurry preparation examples A to F, and any one of coarse particle slurry preparation examples A to O, respectively.

Example 1

A resin particle slurry containing resin particles with a volume average particle size of 1.7 μm were obtained by the coarse particle slurry preparation example A and the resin particle slurry preparation example A. The resin particle slurry was aggregated by the aggregated particle slurry preparation example A and the obtained aggregate particles were defined as the toner of Example 1.

Example 2

A resin particle slurry containing resin particles with a volume average particle size of 0.4 μm were obtained by the coarse particle slurry preparation example A and the resin particle slurry preparation example B. The resin particle slurry was aggregated by the aggregated particle slurry preparation example A and the obtained aggregate particles were defined as the toner of Example 2.

Example 3

A resin particle slurry containing resin particles with a volume average particle size of 2.0 μm were obtained by the coarse particle slurry preparation example A and the resin particle slurry preparation example C. The resin particle slurry was aggregated by the aggregated particle slurry preparation example A and the obtained aggregate particles were defined as the toner of Example 3.

Example 4

A resin particle slurry containing resin particles with a volume average particle size of 1.7 μm were obtained by the coarse particle slurry preparation example A and the resin particle slurry preparation example A. The resin particle slurry was aggregated by the aggregated particle slurry preparation example B and the obtained aggregate particles were defined as the toner of Example 4.

Example 5

A resin particle slurry containing resin particles with a volume average particle size of 1.9 μm were obtained by the coarse particle slurry preparation example B and the resin particle slurry preparation example A. The resin particle slurry was aggregated by the aggregated particle slurry preparation example C and the obtained aggregate particles were defined as the toner of Example 5.

Example 6

A resin particle slurry containing resin particles with a volume average particle size of 0.3 μm were obtained by the coarse particle slurry preparation example C and the resin particle slurry preparation example A. The resin particle slurry was aggregated by the aggregated particle slurry preparation example C and the obtained aggregate particles were defined as the toner of Example 6.

Example 7

A resin particle slurry containing resin particles with a volume average particle size of 1.6 μm were obtained by the coarse particle slurry preparation example D and the resin particle slurry preparation example A. The resin particle slurry was aggregated by the aggregated particle slurry preparation example A and the obtained aggregate particles were defined as the toner of Example 7.

Example 8

A resin particle slurry containing resin particles with a volume average particle size of 1.7 μm were obtained by the coarse particle slurry preparation example E and the resin particle slurry preparation example A. The resin particle slurry was aggregated by the aggregated particle slurry preparation example A and the obtained aggregate particles were defined as the toner of Example 8.

Example 9

A resin particle slurry containing resin particles with a volume average particle size of 1.4 μm were obtained by the coarse particle slurry preparation example F and the resin particle slurry preparation example A. The resin particle slurry was aggregated by the aggregated particle slurry preparation example A and the obtained aggregate particles were defined as the toner of Example 9.

Example 10

A resin particle slurry containing resin particles with a volume average particle size of 2.0 μm were obtained by the coarse particle slurry preparation example G and the resin particle slurry preparation example A. The resin particle slurry was aggregated by the aggregated particle slurry preparation example A and the obtained aggregate particles were defined as the toner of Example 10.

Example 11

A resin particle slurry containing resin particles with a volume average particle size of 1.9 μm were obtained by the coarse particle slurry preparation example B and the resin particle slurry preparation example A. The resin particle slurry was aggregated by the aggregated particle slurry preparation example E and the obtained aggregate particles were defined as the toner of Example 11.

Example 12

A resin particle slurry containing resin particles with a volume average particle size of 0.3 μm were obtained by the coarse particle slurry preparation example C and the resin particle slurry preparation example A. The resin particle slurry was aggregated by the aggregated particle slurry preparation example F and the obtained aggregate particles were defined as the toner of Example 12.

Example 13

A resin particle slurry containing resin particles with a volume average particle size of 1.7 μm were obtained by the coarse particle slurry preparation example A and the resin particle slurry preparation example A. The resin particle slurry was aggregated by the aggregated particle slurry preparation example G and the obtained aggregate particles were defined as the toner of Example 13.

Example 14

A resin particle slurry containing resin particles with a volume average particle size of 1.7 μm were obtained by the coarse particle slurry preparation example A and the resin particle slurry preparation example A. The resin particle slurry was aggregated by the aggregated particle slurry preparation example H and the obtained aggregate particles were defined as the toner of Example 14.

Example 15

A resin particle slurry containing resin particles with a volume average particle size of 1.7 μm were obtained by the coarse particle slurry preparation example A and the resin particle slurry preparation example A. The resin particle slurry was aggregated by the aggregated particle slurry preparation example I and the obtained aggregate particles were defined as the toner of Example 15.

Example 16

A resin particle slurry containing resin particles with a volume average particle size of 1.7 μm were obtained by the coarse particle slurry preparation example A and the resin particle slurry preparation example A. The resin particle slurry was aggregated by the aggregated particle slurry preparation example J and the obtained aggregate particles were defined as the toner of Example 16.

Comparative Example 1

A resin particle slurry containing resin particles with a volume average particle size of 1.7 μm were obtained by the coarse particle slurry preparation example A and the resin particle slurry preparation example A. The resin particle slurry was aggregated by the aggregated particle slurry preparation example N and the obtained aggregate particles were defined as the toner of Comparative Example 1.

Comparative Example 2

A resin particle slurry containing resin particles with a volume average particle size of 1.7 μm were obtained by the coarse particle slurry preparation example A and the resin particle slurry preparation example A. The resin particle slurry was aggregated by the aggregated particle slurry preparation example C and the obtained aggregate particles were defined as the toner of Comparative Example 2.

Comparative Example 3

A resin particle slurry containing resin particles with a volume average particle size of 0.1 μm were obtained by the coarse particle slurry preparation example A and the resin particle slurry preparation example D. The resin particle slurry was aggregated by the aggregated particle slurry preparation example A and the obtained aggregate particles were defined as the toner of Comparative Example 3.

Comparative Example 4

A resin particle slurry containing resin particles with a volume average particle size of 3.0 μm were obtained by the coarse particle slurry preparation example A and the resin particle slurry preparation example E. The resin particle slurry was aggregated by the aggregated particle slurry preparation example A and the obtained aggregate particles were defined as the toner of Comparative Example 4.

Reference Example 1

A resin particle slurry containing resin particles with a volume average particle size of 1.9 μm were obtained by the coarse particle slurry preparation example A and the resin particle slurry preparation example F. The resin particle slurry was aggregated by the aggregated particle slurry preparation example A and the obtained aggregate particles were defined as the toner of Reference Example 1.

Reference Example 2

A resin particle slurry containing resin particles with a volume average particle size of 2.0 μm were obtained by the coarse particle slurry preparation example H and the resin particle slurry preparation example D. The resin particle slurry was aggregated by the aggregated particle slurry preparation example A and the obtained aggregate particles were defined as the toner of Reference Example 2.

Reference Example 3

A resin particle slurry containing resin particles with a volume average particle size of 1.2 μm were obtained by the coarse particle slurry preparation example I and the resin particle slurry preparation example A. The resin particle slurry was aggregated by the aggregated particle slurry preparation example A and the obtained aggregate particles were defined as the toner of Reference Example 3.

Reference Example 4

A resin particle slurry containing resin particles with a volume average particle size of 0.4 μm were obtained by the coarse particle slurry preparation example A and the resin particle slurry preparation example B. The resin particle slurry was aggregated by the aggregated particle slurry preparation example K and the obtained aggregate particles were defined as the toner of Reference Example 4.

Reference Example 5

A resin particle slurry containing resin particles with a volume average particle size of 1.7 μm were obtained by the coarse particle slurry preparation example A and the resin particle slurry preparation example A. The resin particle slurry was aggregated by the aggregated particle slurry preparation example L and the obtained aggregate particles were defined as the toner of Reference Example 5.

Reference Example 6

A resin particle slurry containing resin particles with a volume average particle size of 1.7 μm were obtained by the coarse particle slurry preparation example A and the resin particle slurry preparation example A. The resin particle slurry was aggregated by the aggregated particle slurry preparation example M and the obtained aggregate particles were defined as the toner of Reference Example 6.

0.5 part of titanium oxide with a primary particle size of 15 nm having undergone a hydrophobic treatment by a silane coupling agent, and 0.6 part of silica with a particle size of 40 nm having undergone a hydrophobic treatment by a silane coupling agent were mixed as external additives with 100 parts of each of the toners of the Examples, the Comparative Examples and the Reference Examples in a Henschel mixer (manufactured by Mitsui Mining Co.) to obtain an external addition toner. The external addition toner obtained as described above and a carrier formed by coating 0.5 part of styrene-fluoroalkyl methacrylate to ferrite having a volume average particle size of 40 μm based on 100 parts of the ferrite were mixed such that the concentration of the external addition toner was 5% based on the entire amount of the two-component developer to manufacture two component developers containing toners of examples, comparative examples, and reference examples.

For the toners of the examples, the comparative examples and the reference examples, the volume average particle size, the coefficient of variation, absence or presence for the occurrence of image fogging, and the toner strength were evaluated. Further, the yields for the toners of the examples, the comparative examples and the reference examples were determined. The evaluation method and the calculation method for the yield are as described below.

<Volume Average Particle Size and Coefficient of Variation>

20 mg of a specimen and 1 ml of sodium alkyl ether sulfate were added to 50 ml of an electrolyte (ISOTON-II; trade name of products manufactured by Beckman Coulter Inc.) and dispersed by an ultrasonic dispersing apparatus (UH-50; trade name of products manufactured by STM Co.) at an ultrasonic frequency of 20 kHz for 3 min to prepare a specimen for measurement. The specimen for measurement was measured by using a particle size distribution measuring apparatus (Multisizer 3; trade name of products manufactured by Beckman Coulter Inc.) under the conditions for the aperture diameter of 20 μm and the number of particles measured of 50,000 counts to determine the volume average particle size and the standard deviation in the volume particle size distribution based on the volume particle size distribution of the specimen particles. The coefficient of variation (CV value, %) was calculated based on the following equation.

$$\text{CV value}(t)=(\text{Standard deviation in the volume particle size distribution}/\text{Volume average particle size})\times 100$$

The evaluation standard for the volume average particle size is shown below.

"Good": Good. Volume average particle size is 3.0 μm or more and 6.0 μm or less.

"Available": With no problem in practical use. Volume average particle size is 6.0 μm or more and 8.0 μm or less.

"Poor": Not practically usable. Volume average particle size is less than 3.0 μm or larger than 8.0 μm.

The evaluation standard for the coefficient of variation (CV value) is shown below.

"Good": Good. Coefficient of variation is less than 25.

"Available" With no problem in practical use. Coefficient of variation is 25 or more and less than 30.

"Poor": Not practically usable, Coefficient of variation is 30 or more.

<Yield>

The value obtained by dividing the weight of the obtained toner by the weight of a mixture before melt kneading was defined as a yield.

<Presence or Absence of Image Fogging>

Two component developers containing the toners of the examples, the comparative examples, and the reference examples were filled in a commercial copying machine (MX-2700 FG; trade name of products manufactured by Sharp Corp.) and sample images containing a solid portion of 3 cm length and 3 cm width square shape were prepared on A4 size recording paper (common paper, basis weight: 80 g/m$^2$) according to Japanese Industrial Standards (JIS) P0138 such that the toner deposition amount on the solid portion was 0.4 mg/cm$^2$, and the sample images were confirmed visually to conduct evaluation. The evaluation standard is as described below.

"Good": Good. Image fogging is not present in sample images.

"Poor" Not practically usable. Image fogging is present on the sample image.

<Toner Strength>

Two-component developers containing toners of the examples, the comparative examples, and the reference examples were filled in a commercial copying machine (MX-2700 FG; trade name of products manufactured by Sharp Corp.), and charts with a printing rate of 5% were printed continuously on A4 sized recording paper by 20,000 sheets. Then, the two component developer in the developing vessel was collected and separated by a sieve into a toner and a carrier, then the particle size of the toner was measured by a particle size distribution measuring apparatus (Multisizer 3; trade name of products manufactured by Beckman Coulter Inc.) and the existence ratio of fine powder with the particle size of 2.5 μm or less was compared with the existence ratio of a fine powder in the not used toner. The existent ratio of the fine powder was compared by determining the difference between the existence ratio of fine powder in the toner of the examples, the comparative examples, and the reference examples (% for number) and the existence ratio of the fine powder in the not used toner (% for number). The result of evaluation is shown below.

"Good": Good. Difference of the existent ratio of the fine powder is 0 point or more and 2 point or less.

"Available": With no problem in practical use.

Difference of the existence ratio of the fine powder was more than 2 point and less than 5 point.

"Poor": Not practically usable. Difference of the existence ratio of the fine powder was 5 point or more.

<Comprehensive Evaluation>

The evaluation standard of the comprehensive evaluation is as described below.

"Excellent": Excellent. Neither "Available" nor

"Poor" is present in the evaluation results.

"Good": Good. "Poor" is not present and one "Available" is present in the evaluation result.

"Available": No problem in practical use. "Poor" is not present and two or more "Available" are present in the evaluation result.

"Poor" Poor. "Poor" is present in the evaluation result.

Table 4 shows the volume average particle size, the coefficient of valuation, and the yield of the toners of the examples, the comparative examples, and the reference examples. Further, Table 4 also shows the evaluation result of the volume average particle size of the toner, the coefficient of valuation, presence or absence for the occurrence of image fogging, and the toner strength, together with the comprehensive evaluation for the toners of the examples, the comparative examples, and the reference examples.

TABLE 4

| | Coarse particle slurry preparation example | Resin particle slurry preparation example | Particle size of resin particles (mm) | Aggregated particle slurry preparation example | Volume average particle size (mm) | Evaluation | Coefficient of variation (%) | Evaluation | Yield (%) | Image logging | Toner strength | Comprehensive evaluation |
|---|---|---|---|---|---|---|---|---|---|---|---|---|
| Example 1 | A | A | 1.7 | A | 5.6 | Good | 21 | Good | 82 | Good | Good | Excellent |
| Example 2 | A | B | 0.4 | A | 5.3 | Good | 24 | Good | 81 | Good | Good | Excellent |
| Example 3 | A | C | 2.0 | A | 6.0 | Good | 22 | Good | 79 | Good | Good | Excellent |
| Example 4 | A | A | 1.7 | B | 5.9 | Good | 24 | Good | 82 | Good | Good | Excellent |
| Example 5 | B | A | 1.9 | C | 5.1 | Good | 23 | Good | 82 | Good | Good | Excellent |
| Example 6 | C | A | 0.3 | D | 5.8 | Good | 25 | Available | 81 | Good | Good | Good |
| Example 7 | D | A | 1.6 | A | 5.5 | Good | 24 | Good | 80 | Good | Good | Excellent |
| Example 8 | E | A | 1.7 | A | 5.6 | Good | 25 | Available | 82 | Good | Good | Good |
| Example 9 | F | A | 1.4 | A | 5.3 | Good | 22 | Good | 80 | Good | Good | Excellent |
| Example 10 | G | A | 2.0 | A | 5.0 | Good | 25 | Available | 77 | Good | Good | Good |
| Example 11 | B | A | 1.9 | E | 5.1 | Good | 24 | Good | 80 | Good | Good | Excellent |
| Example 12 | C | A | 0.3 | F | 5.0 | Good | 20 | Good | 82 | Good | Good | Excellent |
| Example 13 | A | A | 1.7 | G | 5.3 | Good | 22 | Good | 81 | Good | Good | Excellent |
| Example 14 | A | A | 1.7 | H | 5.7 | Good | 24 | Good | 82 | Good | Good | Excellent |
| Example 15 | A | A | 1.7 | I | 5.9 | Good | 25 | Available | 81 | Good | Good | Good |
| Example 16 | A | A | 1.7 | J | 5.7 | Good | 23 | Good | 80 | Good | Good | Excellent |
| Comparative Example 1 | A | A | 1.7 | N | 8.5 | Poor | 34 | Poor | 82 | Poor | Poor | Poor |
| Comparative Example 2 | A | A | 1.7 | O | 7.5 | Available | 29 | Available | 81 | Poor | Available | Poor |
| Comparative Example 3 | A | D | 0.1 | A | 3.1 | Good | 42 | Poor | 75 | Poor | Good | Poor |
| Comparative Example 4 | A | E | 3.0 | A | 9.2 | Poor | 23 | Good | 82 | Good | Available | Poor |
| Reference Example 1 | A | F | 1.9 | A | 5.4 | Good | 35 | Poor | 77 | Poor | Good | Poor |
| Reference Example 2 | H | D | 2.0 | A | 8.8 | Poor | 29 | Available | 80 | Poor | Poor | Poor |
| Reference Example 3 | I | A | 1.2 | A | 10.1 | Poor | 23 | Good | 82 | Good | Available | Poor |
| Reference Example 4 | A | B | 0.4 | K | 1.7 | Poor | 21 | Good | 75 | Poor | Poor | Poor |
| Reference Example 5 | A | A | 1.7 | L | 11.8 | Poor | 25 | Available | 80 | Good | Available | Poor |
| Reference Example 6 | A | A | 1.7 | M | 1.7 | Poor | 21 | Good | 76 | Poor | Poor | Poor |

From Table 4, it is apparent that the toner obtained by the method of manufacturing the aggregate particles according to the invention has high mechanical strength and small particle size, with narrow particle size distribution width.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing aggregate particles by aggregating resin particles which are dispersed in a resin particle slurry, the method comprising:

a step of passing a resin particle slurry by rotation of a stirring member, through a plurality of resin particle slurry passing holes which penetrate through two or more screen members in their thickness direction, the two or more screen members being disposed so as to surround the stirring member.

2. The method of claim 1, wherein a volume average particle size of the resin particles is in a range of from 0.3 μm to 2 μm.

3. The method of claim 1, wherein the resin particles are obtained by finely granulating coarse particles containing the resin by a high pressure homogenizer method.

4. The method of claim 1, wherein the resin particle slurry contains an anionic dispersant.

5. The method of claim 4, wherein the anionic dispersant is contained in the resin particle slurry at a ratio of 0.1% by weight to 5% by weight based on an entire amount of the resin particle slurry.

6. The method of claim 4, wherein the anionic dispersant is one or more members selected from sulfonic acid type anionic dispersants, sulfate type anionic dispersants, phosphate type anionic dispersants, and polyacrylate salts.

7. The method of claim 1, wherein the resin particle slurry contains a flocculent.

8. The method of claim 7, wherein the flocculant is contained in the resin particle slurry at a ratio of 0.1% by weight to 5% by weight based on an entire amount of the resin particle slurry.

9. The method of claim 7, wherein the flocculant is one or more members selected from monovalent salts, bivalent salts, and trivalent salts.

10. The method of claim 1, wherein the resin particle includes a colorant and a release agent together with a synthetic resin.

* * * * *